US008484906B1

(12) United States Patent
Tarr

(10) Patent No.: US 8,484,906 B1
(45) Date of Patent: Jul. 16, 2013

(54) BOAT COVER FRAME SYSTEM

(71) Applicant: Charles E. Tarr, Brooksville, ME (US)

(72) Inventor: Charles E. Tarr, Brooksville, ME (US)

( * ) Notice: Subject to any disclaimer, the term of this patent is extended or adjusted under 35 U.S.C. 154(b) by 0 days.

(21) Appl. No.: 13/655,266

(22) Filed: Oct. 18, 2012

(51) Int. Cl.
*E04B 1/12* (2006.01)

(52) U.S. Cl.
USPC ..... 52/63; 52/646

(58) Field of Classification Search
USPC ..... 52/63, 646, 653.2, 655.1, 3
See application file for complete search history.

(56) References Cited

U.S. PATENT DOCUMENTS 3,424,178 A * 1/1969 Yazaki ..... 135/157
4,274,222 A * 6/1981 Zahn et al. ..... 446/126
4,352,255 A * 10/1982 Warehime ..... 446/120
5,700,102 A * 12/1997 Feleppa ..... 403/170
6,892,503 B1 * 5/2005 Kang ..... 52/653.2
6,978,731 B2 12/2005 Erbetta
7,472,666 B1 1/2009 Richard et al.
8,033,289 B2 10/2011 Buckley
2003/0005953 A1 1/2003 Erbetta et al.

* cited by examiner

*Primary Examiner* — Basil Katcheves
(74) *Attorney, Agent, or Firm* — Anthony D. Pellegrini

(57) ABSTRACT

A frame system suitable for use on a boat and capable of supporting one or more tarpaulins to protect the boat from the elements, comprising one or more sets of couplers and angle elements adapted to be used with off-the-shelf connecting members, such as PVC pipes, such that when assembled the frame system provides a canopy frame arching over the top side of the boat, with the lateral sides of the frame system sloping upward and meeting over the longitudinal midline of the boat.

20 Claims, 10 Drawing Sheets

BOAT COVER FRAME SYSTEM

BACKGROUND OF THE INVENTION

1. Technical Field

The present invention relates generally to marine accessories. More particularly, the present invention relates to a frame system for use on boats capable of supporting one or more tarpaulins to protect the boat when not in use.

2. Description of Prior Art

Boats in general, and sailboats in particular, are typically removed from the water at the end of the boating season and stored on dry land. Many boats are stored outside, and thus are exposed to the weather. To prevent excess environmental exposure, boats may be covered by one or more tarpaulins, or they may be shrink-wrapped with a polyvinyl or other suitable material. Both methods have their deficiencies. Because the top sides of boats tend to have an irregular configuration extending upward from their decks, with various rails, stanchions, cockpits, seating areas, and in the case of sailboats, masts, spars, rigging, and the like, placing tarpaulins thereupon is difficult, with coverage often incomplete because of the irregularities. While shrink-wrapping boats tends to overcome some of the issues arising with the irregular top sides of boats, it creates its own problems. First, shrink-wrapping is substantially more expensive than using tarpaulins, and removal of a shrink-wrap cover to begin the boating season tends to destroy the cover, thus necessitating a new, expensive cover at the end of each season. Additionally, shrink-wrap covers limit the amount of airflow under the cover, which could increase the chance for the growth of mold and mildew. A shrink-wrap cover may also limit access to the boat under the cover. The use of tarpaulins is also compromised by the irregular topsides of the boat. In most instances, both in the use of tarpaulins and shrink-wrap, in an effort to compensate for this irregularity an ad hoc frame is constructed of lumber or other materials which are found at hand for this purpose. In most instances these frames do not provide a sufficiently uniform surface to adequately compensate for the irregular structure of the boat's topsides. Additionally, most of these frames are not reusable and may used for only a single season.

There is thus demonstrated the need for a system that may be reused for multiple seasons and that overcomes the difficulties associated with the irregularities of the upper decks of boats, while allowing for the use of relatively inexpensive, reusable, and breathable tarpaulins.

It is thus an object of the present invention to present a frame system to be placed onto the deck of a boat capable of supporting one or more tarpaulins or shrink-wrap.

It is a further object of the present invention to present a frame system to be placed onto the deck of a boat that can be easily assembled and disassembled.

It is yet a further object of the present invention to present a frame system to be placed onto the deck of a boat that is easily customizable to the size and configuration of the boat.

It is yet a further object of the present invention to present a frame system to be placed onto the deck of a boat that is comprised of multiple standard components.

It is yet a further object of the present invention to present a frame system to be placed onto the deck of a boat that is sturdy.

It is yet a further object of the present invention to present a frame system to be placed onto the deck of a boat that does not mar the deck surface.

It is yet a further object of the present invention to present a frame system to be placed onto the deck of a boat that is inexpensive to manufacture.

It is yet a further object of the present invention to present a frame system to be placed onto the deck of a boat that is simple to use.

Other objects of the present invention will be readily apparent from the description that follows.

SUMMARY OF THE INVENTION

The present invention discloses a frame system suitable for use on a marine vessel and capable of supporting one or more tarpaulins or shrink-wrap to protect the marine vessel from the elements. The frame system comprises several standard components which can be coupled with readily available, inexpensive off-the-shelf connecting members. When assembled, the frame system provides a canopy frame arching over the top side of the boat, with lateral sides of the frame system sloping upward and meeting over the longitudinal midline of the boat.

In its most basic form, the frame system comprises a pair of five-arm couplers, a pair of front and rear angle elements, and two pairs of left and right angle elements. Each five-arm coupler has associated with it one left angle element and one right angle element. The front-most five-arm coupler also has associated with it the front angle element and the rear-most five-arm coupler has associated with it the rear angle coupler. These components are suitably adapted to be connected to each other by use of standard PVC pipes or other long, rigid, pole-like members, such as wooden dowels or metal rods. In the preferred embodiments, each of the couplers and angle elements has connection elements that are configured to receive internally the ends of standard PVC pipes or other connecting members (e.g., female ends adapted to receive the male ends of the connecting members). The lengths of the connecting members and the number of couplers and angle elements dictate the ultimate configuration of the frame system. Longer lengths of lateral connecting members inserted into the couplers and angle elements allow for a frame system to fit over a wider vessel; additional couplers and angle elements are added in series, front to rear, to accommodate longer vessels.

In alternate embodiments, the couplers and angle elements project connection stubs which are adapted to fit into the end openings of PVC pipes (e.g., male ends adapted to fit into the female ends of the connecting members). In yet other embodiments, the couplers and angle elements may comprise a mix of male and female ends, as described above. In yet other embodiments, the connection elements of the couplers and angle elements may be threaded, and accommodate threaded connecting members. The threads may be internal to the connection elements, to accommodate externally threaded connecting members, or the threads may be external to the connection elements, to accommodate internally threaded connecting members, or a mix of internally and externally threaded connecting members. Threaded adapters may be used with standard non-threaded connecting members.

In yet other embodiments, a sailboat mast bracket may be included to connect portions of the frame system on either side of a sailboat mast. In such embodiments three-arm couplers and ninety degree angle couplers are used, joined together by connecting members, to form a substantially rectangular frame that surrounds the mast and is connected front and rear to the front and rear portions of the frame system.

In all embodiments, the bottom ends of the base members of the frame system may be finished with protective caps to prevent marring of the deck or bright work.

It is to be understood that the foregoing and following description of the invention is intended to be illustrative and exemplary rather than restrictive of the invention as claimed. These and other aspects, advantages, and features of the invention will become apparent to those skilled in the art after review of the entire specification, accompanying figures, and claims incorporated herein.

DETAILED DESCRIPTION OF THE INVENTION

Figure 1B:
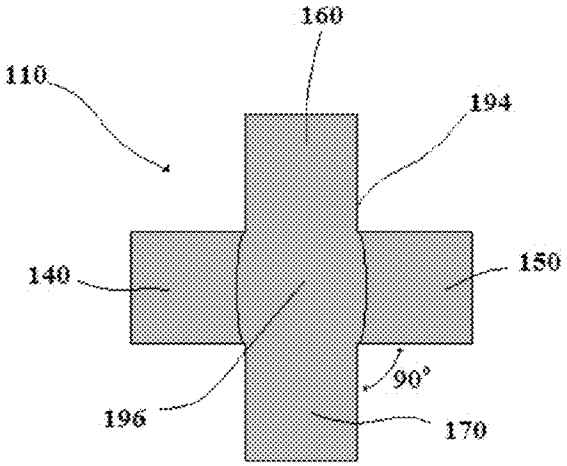
FIG. 1B is a top view of the five-arm coupler depicted in FIG. 1A.
Figure 1C:
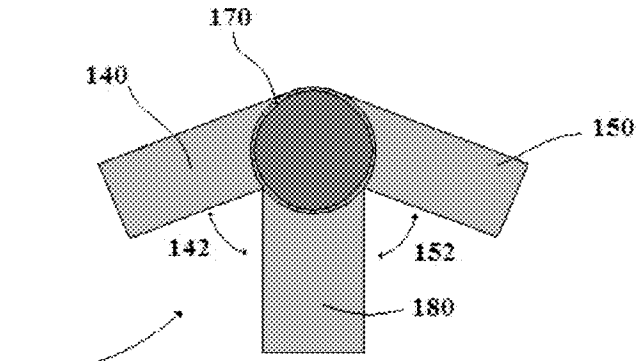
FIG. 1C is a rear view of the five-arm coupler depicted in FIG. 1A.
Figure 1A:
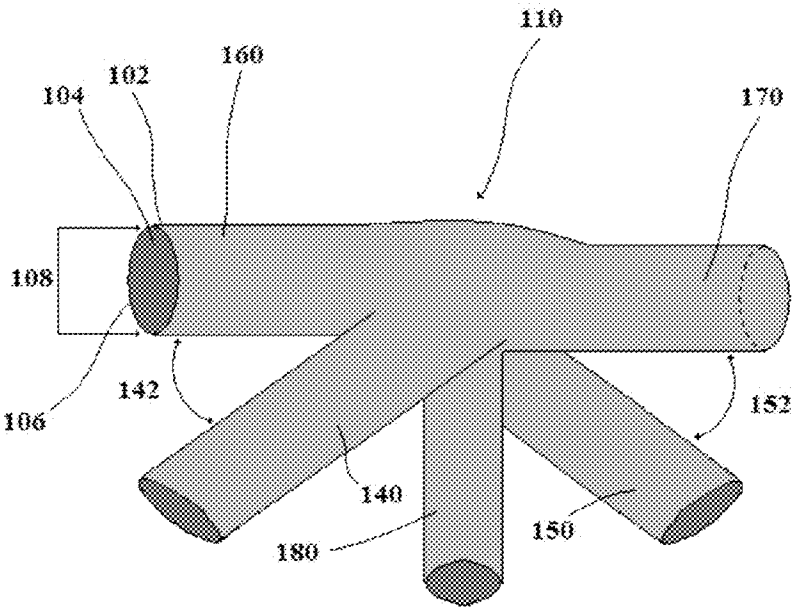
FIG. 1A is a perspective side view of the five-arm coupler of the present invention.

The five-arm coupler 110 of the frame system 1 comprises five connection elements, with four connection elements being substantially coplanar and oriented substantially horizontally, forming a cross, and the fifth connection element extending downward and oriented substantially perpendicular to the other connection elements. See FIGS. 1A, 1B, and 1C. The connection elements are rigid and fixedly attached to each other such that their relative orientations to each other remain constant. Alternatively, the five-arm coupler 110 may be formed of a single piece of material, such as injection molded plastic. Any suitable material may be used for the five-arm coupler 110.

The front connection element 160 of the five-arm coupler 110 is oriented substantially collinear with the rear connection element 170. Together, the front and rear connection elements 160,170 form a substantially cylindrical cross member 194 having openings at opposite ends. The cross member 194 is oriented substantially horizontally. The left connection element 140 of the five-arm coupler 110 is located at a midsection 196 of the cross member 194 formed by the front and rear connection elements 160,170 and is oriented substantially perpendicular to the cross member 194. Further, the left connection element 140 is oriented at an angle 142 of between twenty and seventy degrees to the plane of the cross member 194. Preferably, the left connection element 140 is oriented at an angle 142 of about thirty degrees to the plane of the cross member 194. The right connection element 150 is located opposite the cross member 194 from the left connection element 140 and is oriented substantially perpendicular to the cross member 194. It is also oriented at an angle 152 to the plane of the cross member 194 of substantially the same angle as that of the left connection element 140, on the same side of the plane of the cross member 194 as the left connection element 140. The vertical connection element 180 is located at the midsection 196 of the cross member 194 between the left and right connection elements 140,150 and oriented substantially perpendicular to the plane of the cross member 194 on the same side of the plane of the cross member 194 as the left connection element 140.

The five-arm coupler 110 is adapted to be used with connecting members 300, each of which is an elongate, substantially rigid rod or pole. See FIGS. 4A, 4B, 4C, and 4D. Each connecting member 300 has an end 302 that is adapted to be attached to a connection element. Connecting members 300 are preferably lengths of PVC pipe. PVC pipe can be readily obtained from common suppliers and cut to the exact length needed to create a custom fitted frame system 1. However, other materials may also be appropriate for connecting members 300, such as wooden dowels or metal rods.

Each of the connection elements of the five-arm coupler 110 is substantially elongate and substantially cylindrical. In the preferred embodiment each connection element has an outer end 102 and a hollow interior 104, an opening 106 through the outer end 102 allowing access into the interior 104, and a substantially uniform inside diameter 108. In the preferred configuration, each connection element has substantially the same inside diameter 108 as each other connection element. This configuration allows an end 302 of a connecting member 300 to be inserted into the hollow interior 104 of the connection element, and secured thereto. The connecting member 300 may be secured to the connection element by mechanical fasteners, such as screws, bolts, clips, or the like, or by the use of adhesives, or simply by friction fittings, whereby the inside diameter 108 of the connection element is substantially equivalent to the outside diameter 306 of the end 302 of the connecting member 300. Where the frame system 1 is intended to be disassembled when not in use, mechanical fasteners or friction fittings are used. Alternatively, a combination of mechanical fasteners, adhesives, and/or friction fittings may be used.

In an alternative embodiment each connection element has an outer end 102 having a substantially uniform outside diameter 109. In the preferred configuration, each connection element has substantially the same outside diameter 109 as each other connection element. This configuration allows a connecting member 300 to be placed over the outer end 102 of the connection element, and secured thereto. The connecting member 300 may be secured to the connection element by mechanical fasteners, such as screws, bolts, clips, or the like, of by the use of adhesives, or simply by friction fittings, whereby the outside diameter 109 of the connection element is substantially equivalent to the inside diameter 307 of the end 302 of the connecting member 300.

Figure 5:
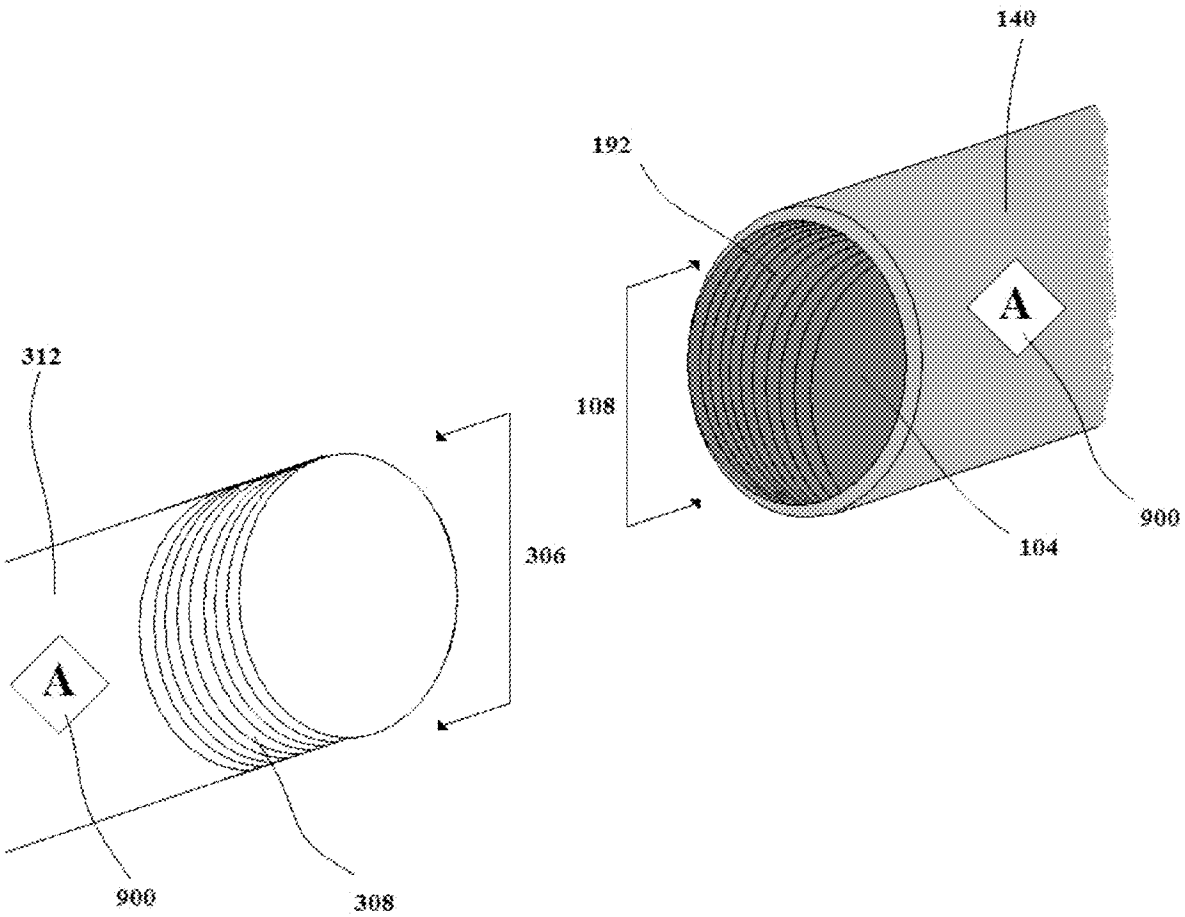
FIG. 5 is a perspective view of the of the connection interface between a connection element and a connecting member, whereby the configuration having a connection element with inside threads and a connecting member with outside threads is shown.
Figure 6:
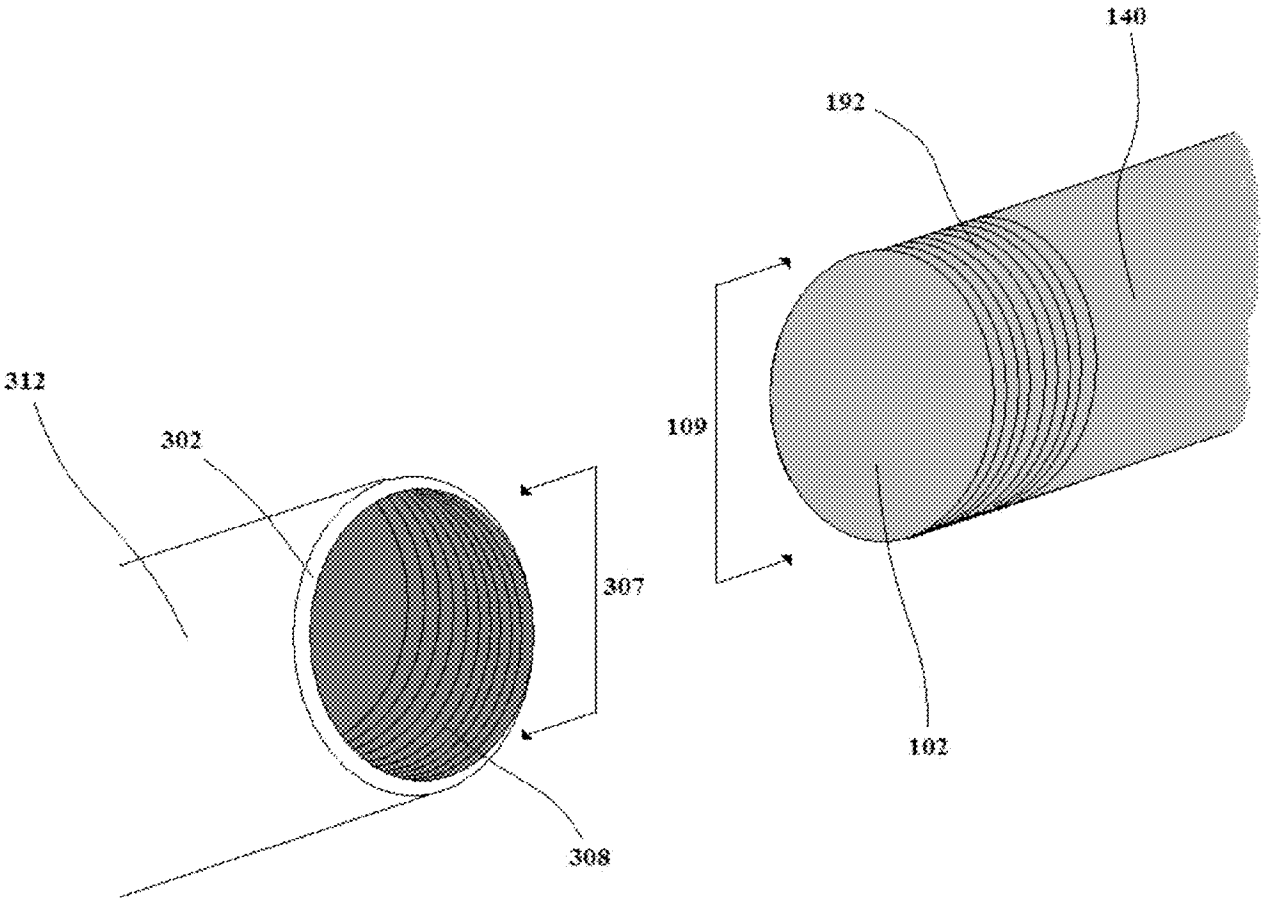
FIG. 6 is a perspective view of the of the connection interface between a connection element and a connecting member, whereby the configuration having a connection element with outside threads and a connecting member with inside threads is shown.

In yet other alternative embodiments each connection element is threaded, as are the ends 302,304 of the connecting members 300. In one configuration the inside of each connection element has threads 192, and the ends 302,304 of the connecting members 300 have matching outer threads 308. See FIGS. 4B and 5. The connecting members 300 are attached to the connection elements by threading the ends 302,304 of the connecting members 300 into the interiors 104 of the connection elements. In another configuration the outside of each connection element is threaded, and the ends 302,304 of the connecting members 300 have matching inner threads 308. See FIGS. 4C and 6. The connecting members 300 are attached to the connection elements by threading the ends 302,304 of the connecting members 300 into the interiors 104 of the connection elements. In either configuration, an adapter 390 may be used to create the threads 392 on the ends 302,304 of the connecting members 300. See FIG. 4D. The adapter 390 may be permanently or temporarily affixed to the end 302 of the connecting member 300 using any of the means discussed herein. The placement of the threads 192 on the connection elements and threads 392 on the ends 302,304 of the connecting members 300 may be mixed between internal and external threads, as desired. In all of these configurations, the threaded connection elements and connecting members 300 allow frame system 1 to be easily assembled and disassembled.

Figure 2:
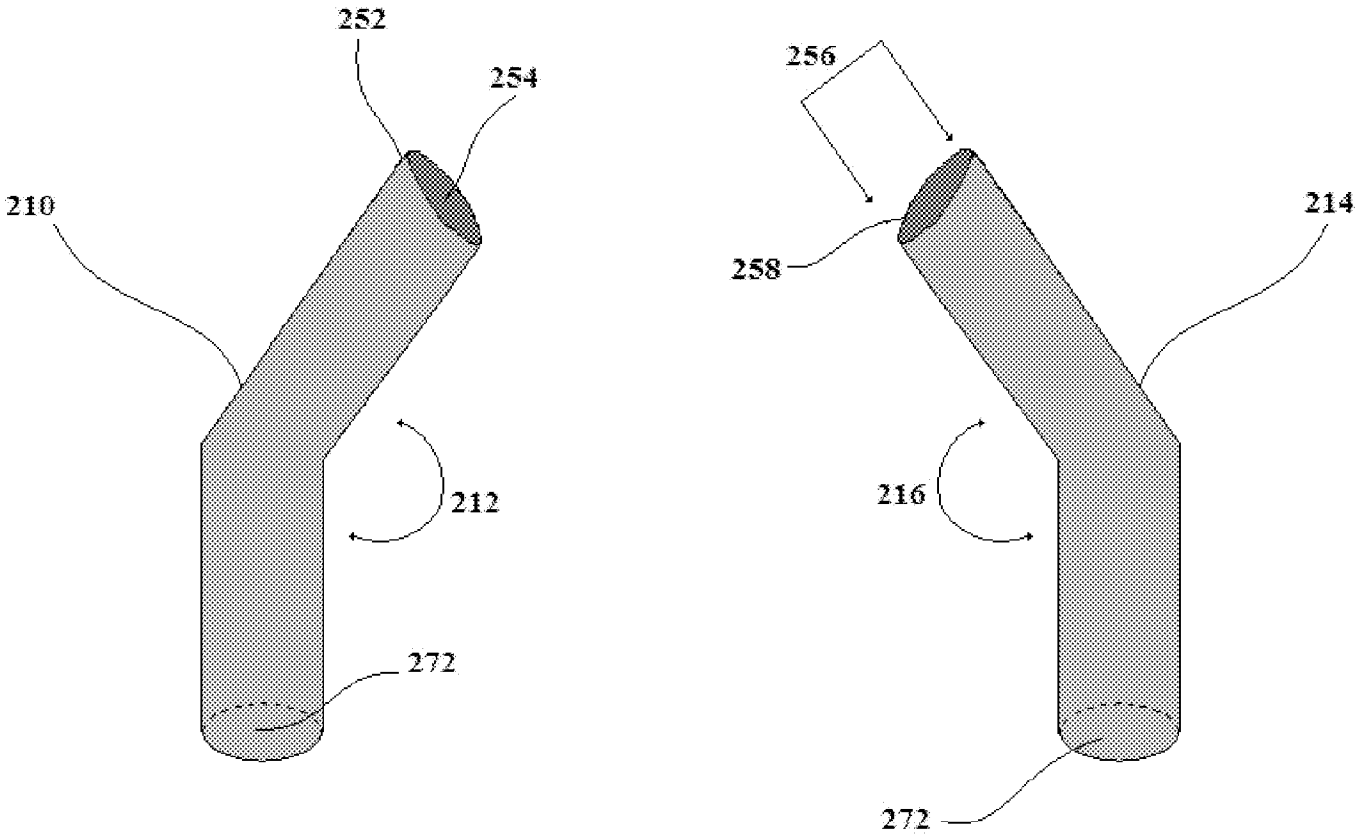
FIG. 2 is a perspective side view of the left angle element and the right angle element of the present invention.
Figure 3:
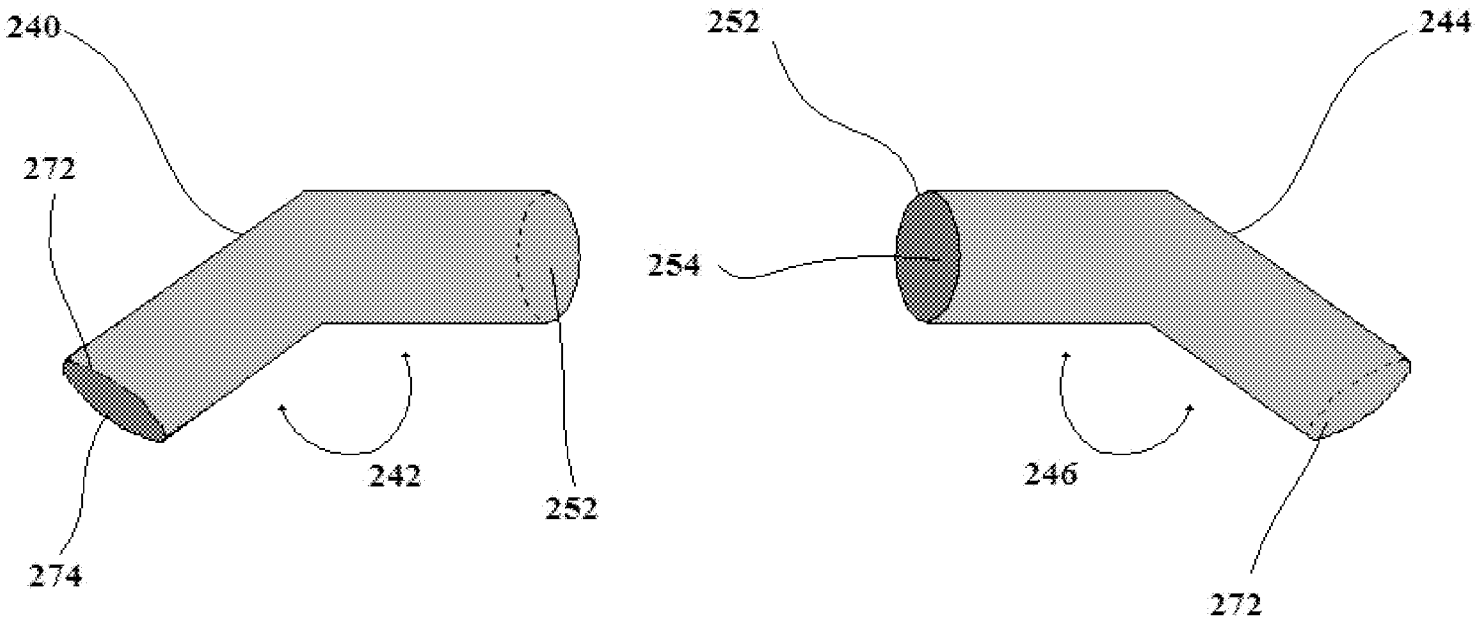
FIG. 3 is a perspective side view of the front angle element and the rear angle element of the present invention.
Figure 4A:
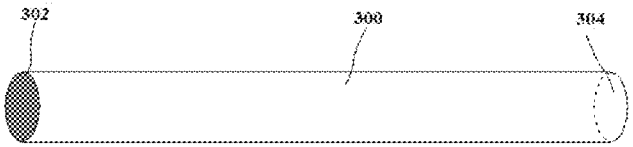
FIG. 4A is a perspective side view of one embodiment of a connecting member that may be used with the present invention.
Figure 4B:
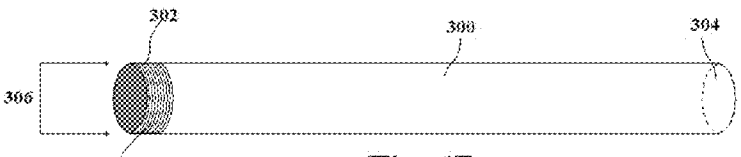
FIG. 4B is a perspective side view of an alternative embodiment of a connecting member that may be used with the present invention, whereby the connecting member has outside threads which may be inserted into the threaded end of a connection element of a coupler or angle element.
Figure 4C:
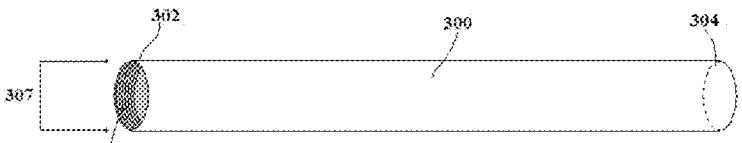
FIG. 4C is a perspective side view of another alternative embodiment of a connecting member that may be used with the present invention, whereby the connecting member has inside threads which may be placed over the threaded end of a connection element of a coupler or angle element.
Figure 4D:
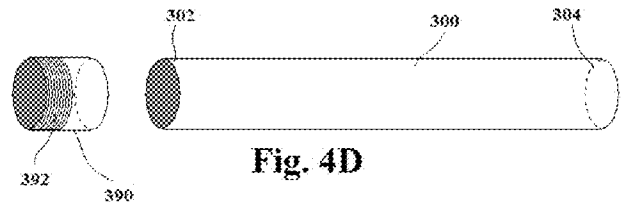
FIG. 4D is a perspective side view of yet another alternative embodiment of a connecting member that may be used with the present invention, whereby a threaded adapter is used with the connecting member such that, once the adapter is affixed to the connecting member, the outside threads of the adapter may be inserted into the threaded end of a connection element of a coupler or angle element.

The frame system 1 also includes a left angle element 210, a right angle element 214, a front angle element 240, and a rear angle element 244. See FIGS. 2 and 3. Each of the angle elements of the frame system 1 has a first end 252 and a second end 272. Each of the angle elements is substantially elongate and substantially cylindrical. The angle elements are rigid and may be formed from injection molded plastic. Any suitable material may be used for the angle elements. In the preferred embodiments the first end 252 of each angle element has a hollow interior 254, a substantially uniform inside diameter 256, and an opening 258 allowing access into the interior 254. Likewise, the second end 272 of each angle element has a hollow interior 274, a substantially uniform inside diameter, and an opening allowing access into the interior. The first and second ends 252,272 of each angle element are oriented at an angle 212,216 to each other. This configuration allows an end 302 of a connecting member 300 to be inserted into the hollow interior 254,274 of an angle element, and secured thereto as described above. In an alternative embodiment the first and second ends 252,272 of each angle element have a substantially uniform outside diameter. This configuration allows an end 302 of a connecting member 300 to be placed over an end 252 of an angle element, and secured thereto as described above. In yet another embodiment, the ends 252,272 of the angle elements may be threaded, as described above, to accommodate the threaded ends of connecting members 300.

With regard to the left and right angle elements 210,214, the angle 212,216 between the first and second ends 252,272 is delta degrees, whereby delta is the difference between ninety degrees and the degree of the angle 142 between the outer end 102 of the left connection element 140 of the five-arm coupler 110 and the plane of the cross member 194. Thus, for example, where the angle 142 between the outer end 102 of the left connection element 140 of the five-arm coupler 110 and the plane of the cross member 194 is forty-five degrees, the angle 212,216 (delta) between the first and second ends 252,272 of the left and right angle elements 210,214 is also forty-five degrees. In the preferred embodiment the angle 142 between the outer end 102 of the left connection element 140 of the five-arm coupler 110 and the plane of the cross member 194 is thirty degrees and the angle 212 (delta) between the first and second ends 252,272 of the left angle element 210 is sixty degrees. The right angle element 214 is similarly configured with respect to the right connection element 150 of the five-arm coupler 110. With regard to the front and rear angle elements 240,244, the angle 242,246 between the first and second ends 252,272 is between twenty and seventy degrees. In the preferred embodiment the angle 242,246 between the first and second ends 252,272 is sixty degrees.

Figure 7:
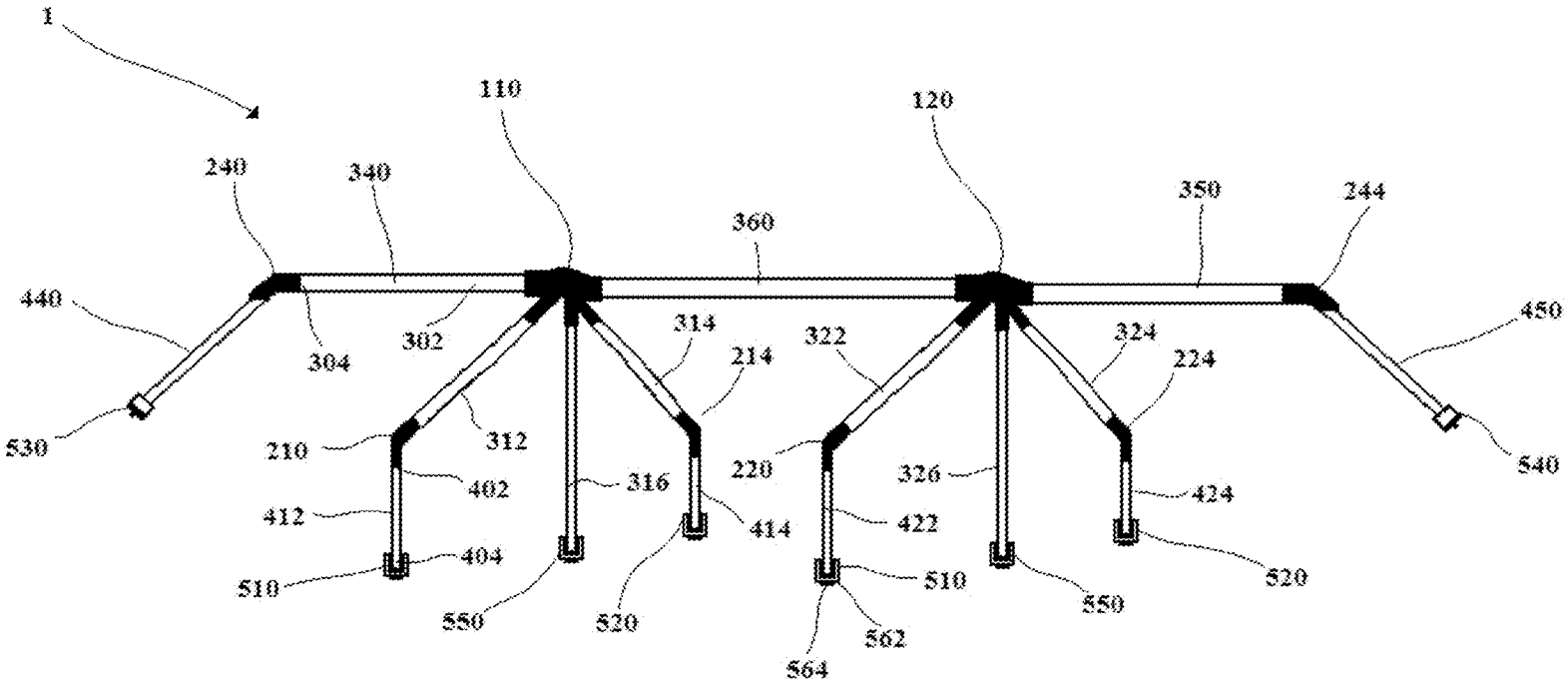
FIG. 7 is a schematic view of the of the frame system of the present invention having two five-arm couplers.
Figure 10:
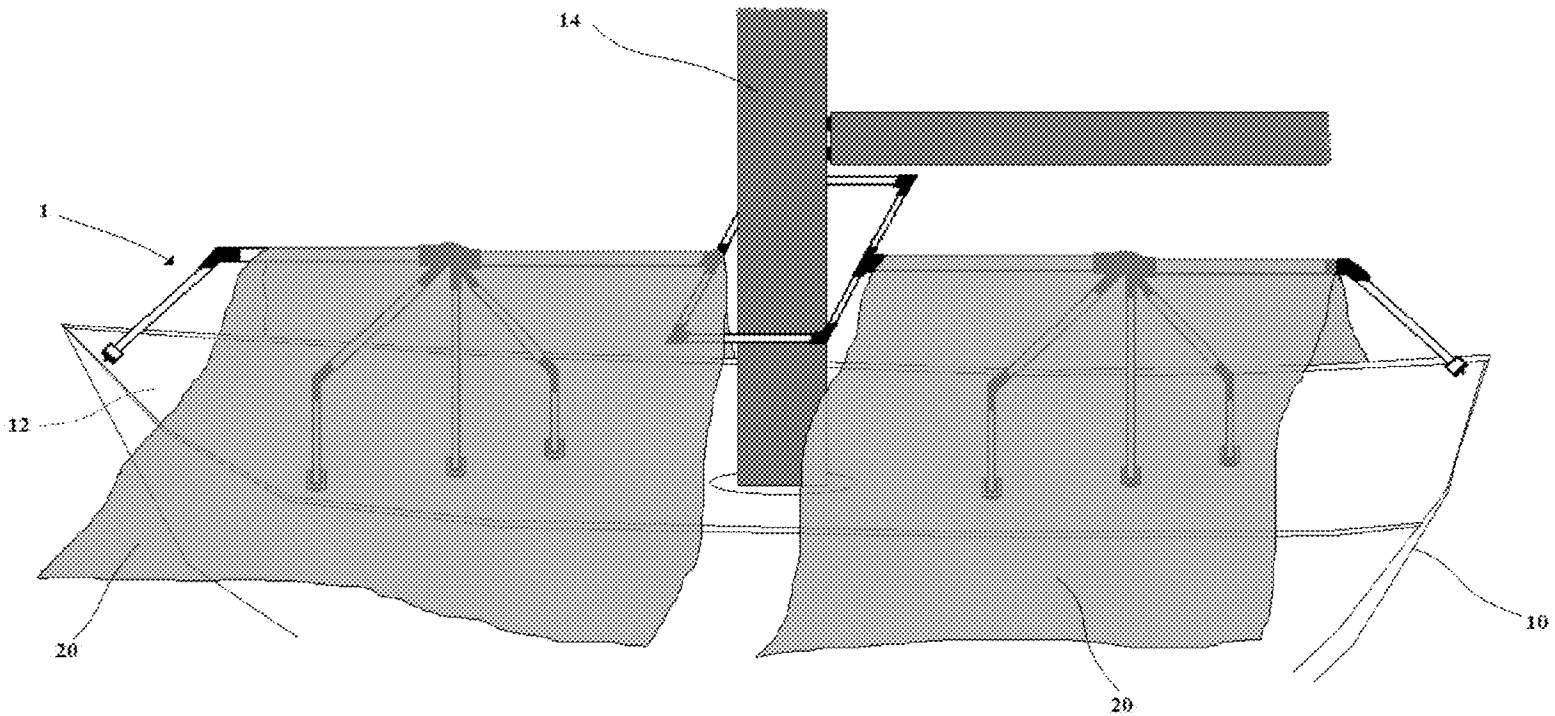
FIG. 10 is a schematic view of the of the frame system of the present invention having two five-arm couplers and a mast bracket, placed onto the deck of a boat, with a pair of tarpaulins placed over the frame system (elements behind the tarpaulins are showed grayed out).

The angle elements of the frame system 1 are connected to the five-arm coupler 110 as follows: a left connecting member 312 is interposed between the left connection element 140 of the five-arm coupler 110 and the left angle element 210 and attached to each at each end; a right connecting member 314 is interposed between the right connection element 150 of the five-arm coupler 110 and the right angle element 214 and attached to each at each end; a front connecting member 340 is interposed between the front connection element 160 of the five-arm coupler 110 and the front angle element 240 and attached to each at each end; and a rear connecting member 350 is interposed between the rear connection element 170 of the five-arm coupler 110 and the rear angle element 244 and attached to each at each end. In addition, a vertical connecting member 316 is attached to the vertical connection element 180 of the five-arm coupler 110. See FIG. 7. Each angle element further may be connected to a base member. A base member is essentially the same item as a connecting member 300, having a first (proximate) end 402 and a second (distal) end 404, cut down to an appropriate length. The base members are connected to the angle elements as follows: a left base member 412 is attached to the left angle element 210; a right base member 414 is attached to the right angle element 214; a front base member 440 is attached to the front angle element 240; and a rear base member 450 is attached to the rear angle element 244. The base members are attached to the angle elements in the same manner as the connecting members 300 are attached to the five-arm coupler 110 and to the angle elements. So configured, with couplers, angle elements, connecting members, and base members, the frame system 1 may be placed on the deck 12 of a boat 10 and one or more tarpaulins 20 may be placed over the frame system 1. See FIG. 10.

The frame system 1 may further comprise a set of end caps to be placed onto the distal ends 404 of the base members. These include a left end cap 510, a right end cap 520, a center end cap 550, a front end cap 530, and a rear end cap 540. See FIG. 7. The end caps are adapted to provide a protective interface between the base members of the frame system 1 and the portions of the boat 10 onto which the frame system 1 is placed. In one embodiment the end caps have a cup-like configuration into which the distal ends 404 of the base members are placed. In other embodiments the end caps fit into the distal ends 404 of the base members. In such embodiments the end cap has an inverted mushroom configuration whereby the stem (male fitting) is inserted into an opening at the distal end (female fitting) 404 of the base member. In these embodiments the end caps are secured to the distal ends 404 of the base members with mechanical fasteners, adhesives, or friction fittings, as described above. In yet another embodiment the end caps may be threaded, as described above, and are attached to the base members by being threaded onto the threaded distal ends 404 of the base members. In yet another embodiment whereby the end caps have an inverted mushroom configuration, as described above, the stem may have external threads and may be threaded into the internally threaded distal ends 404 of the base members. A mix of internally threaded and externally threaded end caps is also contemplated.

Figure 8:
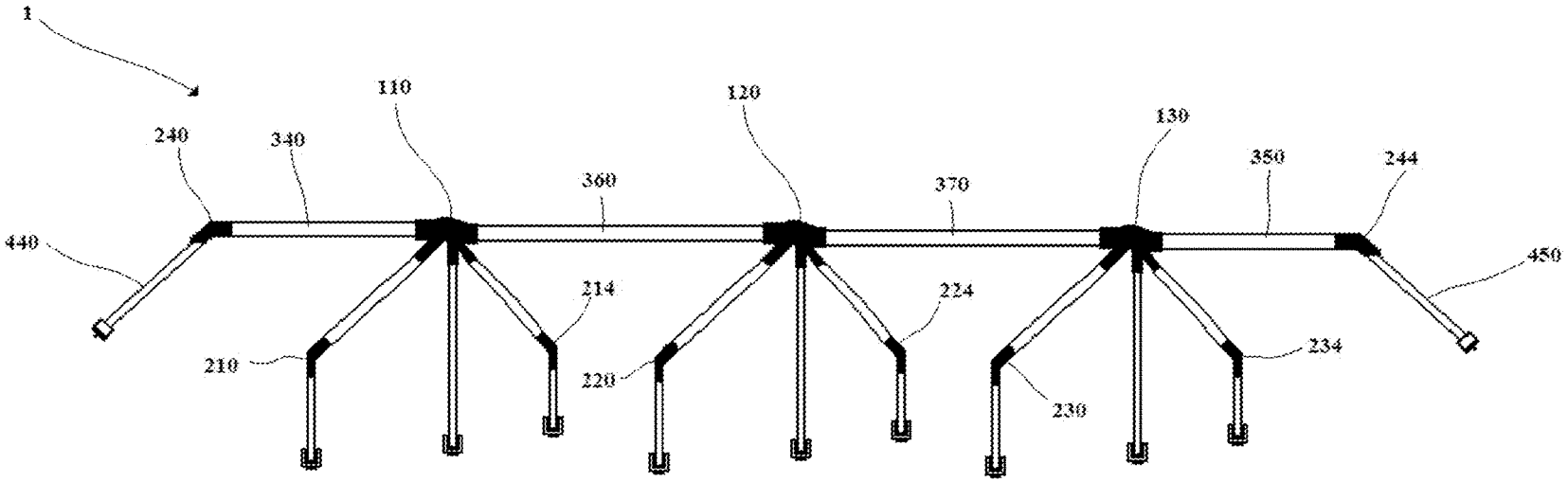
FIG. 8 is a schematic view of the of the frame system of the present invention having three five-arm couplers.

In the preferred embodiments the end caps have a bottom side 562 located opposite the attachment point between the base member and the end cap. The bottom side 562 of the end cap has attached to it a cushioning substance 564 to protect the surface of the boat 10. The cushioning substance 564 may be made of rubber, felt, or any other malleable material. In one configuration the cushioning substance 564 may be a cushioned pad covering substantially all of the bottom side 562 of the end cap. In another embodiment it may be a standard crutch tip, fitted over a projection extending from the bottom side 562 of the end cap. In yet another embodiment the end cap may comprise a cushioned circumferential ring. In yet another embodiment there may be a plurality of small cushioned pads attached to the bottom side 562 of the end cap. There may further be a central aperture passing through the bottom side 562 of the end cap so that the base member to which the end cap is fitted can be placed over a stanchion or other items projecting upwards from the boat 10.

Where a larger frame system 1 is required, the frame system 1 may further comprise a second five-arm coupler 120 and a second pair of left and right angle elements 220,224. See FIG. 7. The second five-arm coupler 120 may be configured substantially the same as the first five-arm coupler 110 as described above, in all of its variations. Similarly, the second left angle element 220 may be configured substantially the same as the first left angle element 210 as described above, and the second right angle element 224 may be configured substantially the same as the first right angle element 214 as described above. These additional components will have associated with them a second left connecting member 322, a second right connecting member 324, and a second vertical connecting member 326, as well as a second left base member 422 and a second right base member 424. To connect the second five-arm coupler 120 to the first five-arm coupler 110, an intermediate connecting member 360, configured substantially the same as the other connecting members 300 as described above, is interposed between the two five-arm couplers 110,120 and attached at one end to the rear connection element 170 of the first five-arm coupler 110 and attached at its other end to the front connection element 160 of the second five-arm coupler 120. The rear connecting member 350 is connected to the rear connection element 170 of the second five-arm coupler 120.

Where even larger frame systems 1 are required, one or more additional five-arm couplers 130 may be added between the first and second five-arm couplers 110,120, each configured as described above, together with associated left and right angle elements 230,234. See FIG. 8. To connect the additional five-arm couplers 130 to the first and second five-arm couplers 110,120, additional intermediate connecting members, configured substantially the same as the other connecting members 300 as described above, are interposed between the five-arm couplers 110,120,130 and attached thereto. Thus, for example, a completed frame system 1 may have four five-arm couplers, each with an associated left and right angle element, joined together by three intermediate connecting members, with the front-most (first) five-arm coupler 110 having the front connecting member 340 attached to its front connection element 160 and the rear-most (fourth) five-arm coupler having the rear connecting member 350 attached to its rear connection element 170. Where multiple five-arm couplers are used, the associated connecting members and base members may be of different length. This allows for customization of the frame system 1. For example, if the boat 10 has a closed forward deck 12 but an open rear cockpit, the left and right base members 412,414 and vertical connecting member 316 associated with the forward five-arm coupler 110 may be of shorter length than the left and right base members 422,424 and vertical connecting member 326 associated with the rearward five-arm coupler 120. Similarly, where there is structure located on one side of the boat 10 but not on the other, the associated left and right connecting and base members may be of different lengths.

Figure 9:
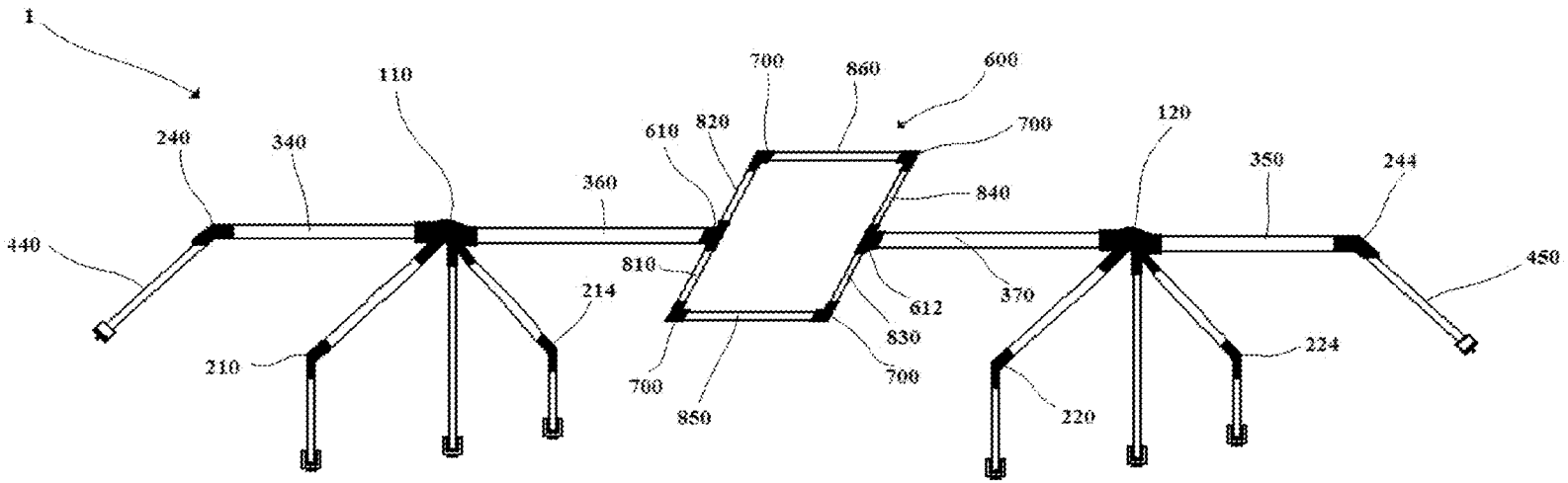
FIG. 9 is a schematic view of the of the frame system of the present invention having two five-arm couplers joined by a mast bracket.

One embodiment of the frame system 1 further comprises a mast bracket 600 suitably adapted to accommodate a sailboat mast 14. See FIG. 9. The mast bracket 600 allows a front portion of the frame system 1 to be connected to a rear portion of the frame system 1 located on opposite sides of the sailboat mast 14. The mast bracket 600 is comprised of a front three-arm coupler 610, a rear three-arm coupler 612, and four ninety degree angle couplers 700.

Each three-arm coupler 600,612 of the mast bracket 600 has a left connection element, a right connection element, and a horizontal connection element. The connection elements are substantially elongate and substantially cylindrical and have an outer end and a hollow interior. An opening through the outer end of each connection element allows access into the interior. In one embodiment the connection elements have a substantially uniform inside diameter. The connection elements are rigid and fixedly attached to each other such that their relative orientations to each other remain constant. Alternatively, each three-arm coupler 610,612 may be formed of a single piece of material, such as injection molded plastic. Any suitable material may be used for the three-arm couplers 610,612. In an alternative embodiment, the left, right, and horizontal connection elements of each three-arm coupler 610,612 have a substantially uniform outside diameter. In yet another alternative embodiment, the left, right, and horizontal connection elements of each three-arm coupler 610,612 have threaded ends, either having inside threads or outside threads, as described above.

The left connection element of each three-arm coupler 610,612 is oriented substantially collinear with the right connection element. Together, the front and rear connection elements form a substantially cylindrical cross member having openings at opposite ends. The horizontal connection element is located at a midsection of the cross member between the left and right connection elements and oriented substantially perpendicular to the cross member.

Each ninety degree angle coupler 700 of the mast bracket 600 has a first end and a second end, and is substantially elongate and substantially cylindrical. The ninety degree angle couplers 700 are rigid and may be formed from injection molded plastic. Any suitable material may be used for the ninety degree angle couplers 700. In the preferred embodiments the first end of each ninety degree angle coupler 700 has a hollow interior, a substantially uniform inside diameter, and an opening allowing access into the interior. Likewise, the second end of each ninety degree angle coupler 700 has a hollow interior, a substantially uniform inside diameter, and an opening allowing access into the interior. The first and second ends of each ninety degree angle coupler 700 are oriented at a ninety degree angle to each other. This configuration allows an end 302 of a connecting member 300 to be inserted into the hollow interior of the ninety degree angle coupler 700, and secured thereto as described above. In an alternative embodiment the first and second ends of each ninety degree angle coupler 700 have a substantially uniform outside diameter. This configuration allows an end 302 of a connecting member 300 to be placed over an end of the ninety degree angle coupler 700, and secured thereto as described above. In yet another embodiment, the ends of the ninety degree angle couplers 700 may be threaded, as described above, to accommodate the threaded ends 302,304 of connecting members 300.

Six horizontal connecting members are used to connect the couplers 610,612,700 of the mast bracket 600. Each horizontal connecting member is an elongate, substantially rigid rod or pole. Each horizontal connecting member has an end that is adapted to be attached to a connection element of the three-arm couplers 610,612 or to an end of the ninety degree angle couplers 700. Horizontal connection elements are preferably lengths of PVC pipe cut to the exact length needed to create a custom fitted mast bracket 600. However, other materials may also be appropriate for horizontal connection members, such as wooden dowels or metal rods. The horizontal connecting members may be secured to the connection elements of the three-arm couplers 610,612 or to the ends of the ninety degree angle couplers 700 by mechanical fasteners, such as screws, bolts, clips, or the like, or by the use of adhesives, or by friction fittings.

The ninety degree angle couplers 700 are connected to the three-arm couplers 610,612 as follows: a first horizontal connecting member 810 is interposed between the left connection element of the front three-arm coupler 610 and one of the ninety degree angle couplers 700 and attached to each at each end; a second horizontal connecting member 820 is interposed between the right connection element of the front three-arm coupler 610 and the second ninety degree angle coupler 700 and attached to each at each end; a third horizontal connecting member 830 is interposed between the left connection element of the rear three-arm coupler 612 and the third ninety degree angle coupler 700 and attached to each at each end; a fourth horizontal connecting member 840 is interposed between the right connection element of the rear three-arm coupler 612 and the fourth ninety degree angle coupler 700 and attached to each at each end; a fifth horizontal connecting member 850 is interposed between the first ninety degree coupler 700 and the third ninety degree coupler 700 and attached to each at its ends; and a sixth horizontal connecting member 860 is interposed between the second ninety degree coupler 700 and the fourth ninety degree coupler 700 and attached to each at its ends. The three-arm couplers 610, 612, the ninety degree angle couplers 700, and the horizontal connecting members 810,820,830,840,850,860 are assembled around the sailboat mast 14. At least a pair of the connections between the components of the mast bracket 600 should be capable of being disassembled, to permit the mast bracket 600 to be removed from around the sailboat mast 14 when its use is not needed.

The mast bracket 600, assembled as described above, is connected to a forward portion of the frame system 1 and to a rear portion of the frame system 1 as follows: a first intermediate connecting member 360 is interposed between the horizontal connection element of the front three-arm coupler 610 and the rear connection element 170 of the five-arm coupler 110 located just forward of the mast bracket 600, and attached to each at its ends; and a second intermediate connecting member 370 is interposed between the horizontal connection element of the rear three-arm coupler 612 and the front connection element 160 of the five-arm coupler 120 located just rearward of the mast bracket 600, and attached to each at its ends.

In yet another embodiment, the frame system 1 further comprises a plurality of stickers 900. See FIG. 5. The stickers 900 are suitable for being affixed to the ends of the connection elements of the five-arm couplers 110, the ends of the connection elements of the three-arm couplers 610, the ends of the left and right angle elements 210,214, the ends of the front and rear angle elements 240,244, and the ends of the ninety degree angle couplers 700. Pairs of stickers 900 are visually complementary, such that each of a complementary pair can be affixed to the ends of connecting components. Thus, after disassembly, the frame system 1 can be reassembled by aligning the complementary pairs of stickers 900, to help keep track of which components fit together with which others. The complementary identifications of the pairs of stickers 900 can be by color, or shape, or text, or a combination of same. For example, the stickers 900 to be placed on the port (left) side of the frame system 1 might be green, the stickers 900 to be placed on the starboard (right) side of the frame system 1 might be red, and the stickers 900 to be placed on the center components might be yellow, with each pair numbered "1-1", "2-2", etc., for each color scheme. Other complementary identifications are also contemplated.

Modifications and variations can be made to the disclosed embodiments of the present invention without departing from the subject or spirit of the invention as defined in the following claims.

I claim:

1. A frame system comprising a first five-arm coupler, the first five-arm coupler having a left connection element, a right connection element, a front connection element, a rear connection element, and a vertical connection element, with each of the connection elements being substantially elongate and substantially cylindrical and having an outer end and a hollow interior, an opening through the outer end allowing access into the interior, and a substantially uniform inside diameter, whereby the front connection element is fixedly attached to and oriented substantially collinear with the rear connection element, forming a substantially cylindrical cross member having openings at opposite ends, the left connection element is fixedly attached to a midsection of the cross member and oriented substantially perpendicular to the cross member and further oriented at an angle of between twenty and seventy degrees to a plane of the cross member, the right connection element is fixedly attached to the midsection of the cross member opposite the left connection element and oriented substantially perpendicular to the cross member and further oriented at an angle to the plane of the cross member of substantially the same angle as that of the left connection element on the same side of the plane of the cross member as the left connection element, the vertical connection element is fixedly attached to the midsection of the cross member between the left connection element and the right connection element and oriented substantially perpendicular to the plane of the cross member on the same side of the plane of the cross member as the left connection element, the outer end of the left connection element is suitably adapted to be in connection with a first end of an elongate first left connecting member such that the first left connecting member is capable of being attached to the left connection element, the outer end of the right connection element is suitably adapted to be in connection with a first end of an elongate first right connecting member such that the first end of the first right connecting member is capable of being attached to the right connection element, the outer end of the front connection element is suitably adapted to be in connection with a first end of an elongate front connecting member such that the first end of the front connecting member is capable of being attached to the front connection element, the outer end of the rear connection element is suitably adapted to be in connection with a first end of an elongate rear connecting member such that the first end of the rear connecting member is capable of being attached to the rear connection element, the outer end of the vertical connection element is suitably adapted to be in connection with a first end of an elongate first vertical connecting member such that the first end of the first vertical connecting member is capable of being attached to the vertical connection element;

a first left angle element and a first right angle element, with each angle element being substantially elongate and having a first end and a second end, with the first end of the angle element being substantially cylindrical and having a hollow interior, a substantially uniform inside diameter, and an opening allowing access into the interior, and the second end of the angle element being substantially cylindrical and having a hollow interior, a substantially uniform inside diameter, and an opening allowing access into the interior, with the first end of the angle element being oriented at an angle of delta degrees in respect to the second end of the angle element, whereby delta is the difference between ninety degrees and the degree of the angle between the outer end of the left connection element and the plane of the cross member, whereby the second end of the first left angle element is suitably adapted to be in connection with a second end of the first left connecting member such that the second end of the first left connecting member is capable of being attached to the first left angle element, the second end of the first right angle element is suitably adapted to be in connection with a second end of the first right connecting member such that the second end of the first right connecting member is capable of being attached to the first right angle element, the first end of the first left angle element is suitably adapted to be in connection with a first end of an elongate first left base member such that the first end of the first left base member is capable of being attached to the first left angle element, and the first end of the first right angle element is suitably adapted to be in connection with a first end of an elongate first right base member such that the first end of the first right base member is capable of being attached to the first right angle element; and a left end cap, a right end cap, and a center end cap, with the left end cap suitably adapted to be in connection with a second end of the first left base member, the right end cap suitably adapted to be in connection with a second end of the first right base member, and the center end cap suitably adapted to be in connection with a second end of the first vertical base member;

wherein each end cap comprises a bottom side located opposite the corresponding base member and having attached to said bottom side one of the following group: a cushioned pad, and a crutch tip.

2. The frame system of claim 1 wherein the outer end of the left connection element is suitably adapted to receive through its opening the first end of the first left connecting member such that the first end of the first left connecting member is capable of being located within the interior of the left connection element, the outer end of the right connection element is suitably adapted to receive through its opening the first end of the first right connecting member such that the first end of the first right connecting member is capable of being located within the interior of the right connection element, the outer end of the front connection element is suitably adapted to receive through its opening the first end of the front connecting member such that the first end of the front connecting member is capable of being located within the interior of the front connection element, the outer end of the rear connection element is suitably adapted to receive through its opening the first end of the rear connecting member such that the first end of the rear connecting member is capable of being located within the interior of the rear connection element, the outer end of the vertical connection element is suitably adapted to receive through its opening the first end of the first vertical connecting member such that the first end of the first vertical connecting member is capable of being located within the interior of the vertical connection element, the second end of the first left angle element is suitably adapted to receive through its opening the second end of the first left connecting member such that the second end of the first left connecting member is capable of being located within the interior of the second end of the first left angle element, the second end of the first right angle element is suitably adapted to receive through its opening the second end of the first right connecting member such that the second end of the first right connecting member is capable of being located within the interior of the second end of the first right angle element, the first end of the first left angle element is suitably adapted to receive through its opening the first end of the first left base member such that the first end of the first left base member is capable of being located within the interior of the first end of the first left angle element, and the first end of the first right angle element is suitably adapted to receive through its opening the first end of the first right base member such that the first end of the first right base member is capable of being located within the interior of the first end of the first right angle element.

3. The frame system of claim 1 wherein the left end cap is suitably adapted to being placed onto the second end of the first left base member, the right end cap is suitably adapted to being placed onto the second end of the first right base member, and the center end cap is suitably adapted to being placed onto the second end of the first vertical base member.

4. A frame system comprising a first five-arm coupler, the first five-arm coupler having a left connection element, a right connection element, a front connection element, a rear connection element, and a vertical connection element, with each of the connection elements being substantially elongate and substantially cylindrical and having an outer end and a hollow interior, an opening through the outer end allowing access into the interior, and a substantially uniform inside diameter, whereby the front connection element is fixedly attached to and oriented substantially collinear with the rear connection element, forming a substantially cylindrical cross member having openings at opposite ends, the left connection element is fixedly attached to a midsection of the cross member and oriented substantially perpendicular to the cross member and further oriented at an angle of between twenty and seventy degrees to a plane of the cross member, the right connection element is fixedly attached to the midsection of the cross member opposite the left connection element and oriented substantially perpendicular to the cross member and further oriented at an angle to the plane of the cross member of substantially the same angle as that of the left connection element on the same side of the plane of the cross member as the left connection element, the vertical connection element is fixedly attached to the midsection of the cross member between the left connection element and the right connection element and oriented substantially perpendicular to the plane of the cross member on the same side of the plane of the cross member as the left connection element, the outer end of the left connection element is suitably adapted to be in connection with a first end of an elongate first left connecting member such that the first left connecting member is capable of being attached to the left connection element, the outer end of the right connection element is suitably adapted to be in connection with a first end of an elongate first right connecting member such that the first end of the first right connecting member is capable of being attached to the right connection element, the outer end of the front connection element is suitably adapted to be in connection with a first end of an elongate front connecting member such that the first end of the front connecting member is capable of being attached to the front connection element, the outer end of the rear connection element is suitably adapted to be in connection with a first end of an elongate rear connecting member such that the first end of the rear connecting member is capable of being attached to the rear connection element, the outer end of the vertical connection element is suitably adapted to be in connection with a first end of an elongate first vertical connecting member such that the first end of the first vertical connecting member is capable of being attached to the vertical connection element;

a first left angle element and a first right angle element, with each angle element being substantially elongate and having a first end and a second end, with the first end of the angle element being substantially cylindrical and having a hollow interior, a substantially uniform inside diameter, and an opening allowing access into the interior, and the second end of the angle element being substantially cylindrical and having a hollow interior, a substantially uniform inside diameter, and an opening allowing access into the interior, with the first end of the angle element being oriented at an angle of delta degrees in respect to the second end of the angle element, whereby delta is the difference between ninety degrees and the degree of the angle between the outer end of the left connection element and the plane of the cross member, whereby the second end of the first left angle element is suitably adapted to be in connection with a second end of the first left connecting member such that the second end of the first left connecting member is capable of being attached to the first left angle element, the second end of the first right angle element is suitably adapted to be in connection with a second end of the first right connecting member such that the second end of the first right connecting member is capable of being attached to the first right angle element, the first end of the first left angle element is suitably adapted to be in connection with a first end of an elongate first left base member such that the first end of the first left base member is capable of being attached to the first left angle element, and the first end of the first right angle element is suitably adapted to be in connection with a first end of an elongate first right base member such that the first end of the first right base member is capable of being attached to the first right angle element; and a left end cap, a right end cap, and a center end cap, with the left end cap suitably adapted to be in connection with a second end of the first left base member, the right end cap suitably adapted to be in connection with a second end of the first right base member, and the center end cap suitably adapted to be in connection with a second end of the first vertical base member;

wherein each end cap comprises a bottom side located opposite the corresponding base member and having attached to said bottom side one of the following group: a cushioned circumferential ring, and a plurality of cushioned pads.

5. The frame system of claim 4 wherein each end cap comprises a central aperture passing through the bottom side.

6. The frame system of claim 4 wherein the outer end of the left connection element is suitably adapted to receive through its opening the first end of the first left connecting member such that the first end of the first left connecting member is capable of being located within the interior of the left connection element, the outer end of the right connection element is suitably adapted to receive through its opening the first end of the first right connecting member such that the first end of the first right connecting member is capable of being located within the interior of the right connection element, the outer end of the front connection element is suitably adapted to receive through its opening the first end of the front connecting member such that the first end of the front connecting member is capable of being located within the interior of the front connection element, the outer end of the rear connection element is suitably adapted to receive through its opening the first end of the rear connecting member such that the first end of the rear connecting member is capable of being located within the interior of the rear connection element, the outer end of the vertical connection element is suitably adapted to receive through its opening the first end of the first vertical connecting member such that the first end of the first vertical connecting member is capable of being located within the interior of the vertical connection element, the second end of the first left angle element is suitably adapted to receive through its opening the second end of the first left connecting member such that the second end of the first left connecting member is capable of being located within the interior of the second end of the first left angle element, the second end of the first right angle element is suitably adapted to receive through its opening the second end of the first right connecting member such that the second end of the first right connecting member is capable of being located within the interior of the second end of the first right angle element, the first end of the first left angle element is suitably adapted to receive through its opening the first end of the first left base member such that the first end of the first left base member is capable of being located within the interior of the first end of the first left angle element, and the first end of the first right angle element is suitably adapted to receive through its opening the first end of the first right base member such that the first end of the first right base member is capable of being located within the interior of the first end of the first right angle element.

7. The frame system of claim 4 wherein the left end cap is suitably adapted to being placed onto the second end of the first left base member, the right end cap is suitably adapted to being placed onto the second end of the first right base member, and the center end cap is suitably adapted to being placed onto the second end of the first vertical base member.

8. A frame system comprising a first five-arm coupler, the first five-arm coupler having a left connection element, a right connection element, a front connection element, a rear connection element, and a vertical connection element, with each of the connection elements being substantially elongate and substantially cylindrical and having an outer end and a hollow interior, an opening through the outer end allowing access into the interior, and a substantially uniform inside diameter, whereby the front connection element of the first five-arm coupler is fixedly attached to and oriented substantially collinear with the rear connection element of the first five-arm coupler, forming a substantially cylindrical cross member having openings at opposite ends, the left connection element of the first five-arm coupler is fixedly attached to a midsection of the cross member of the first five-arm coupler and oriented substantially perpendicular to the cross member of the first five-arm coupler and further oriented at an angle of between twenty and seventy degrees to a plane of the cross member of the first five-arm coupler, the right connection element of the first five-arm coupler is fixedly attached to the midsection of the cross member of the first five-arm coupler opposite the left connection element of the first five-arm coupler and oriented substantially perpendicular to the cross member of the first five-arm coupler and further oriented at an angle to the plane of the cross member of the first five-arm coupler of substantially the same angle as that of the left connection element of the first five-arm coupler on the same side of the plane of the cross member of the first five-arm coupler as the left connection element of the first five-arm coupler, the vertical connection element of the first five-arm coupler is fixedly attached to the midsection of the cross member of the first five-arm coupler between the left connection element of the first five-arm coupler and the right connection element of the first five-arm coupler and oriented substantially perpendicular to the plane of the cross member of the first five-arm coupler on the same side of the plane of the cross member of the first five-arm coupler as the left connection element of the first five-arm coupler, the outer end of the left connection element of the first five-arm coupler is suitably adapted to be in connection with a first end of an elongate first left connecting member, the outer end of the right connection element of the first five-arm coupler is suitably adapted to be in connection with a first end of an elongate first right connecting member, the outer end of the front connection element of the first five-arm coupler is suitably adapted to be in connection with a first end of an elongate front connecting member, the outer end of the rear connection element of the first five-arm coupler is suitably adapted to be in connection with a first end of an elongate rear connecting member, the outer end of the vertical connection element of the first five-arm coupler is suitably adapted to be in connection with a first end of an elongate first vertical connecting member;

a first left angle element and a first right angle element, with each angle element being substantially elongate and having a first end and a second end, with the first end of the angle element being substantially cylindrical and having a hollow interior, a substantially uniform inside diameter, and an opening allowing access into the interior, and the second end of the angle element being substantially cylindrical and having a hollow interior, a substantially uniform inside diameter, and an opening allowing access into the interior, with the first end of the angle element being oriented at an angle of delta degrees in respect to the second end of the angle element, whereby delta is the difference between ninety degrees and the degree of the angle between the outer end of the left connection element and the plane of the cross member, whereby the second end of the first left angle element is suitably adapted to be in connection with a second end of the first left connecting member, the second end of the first right angle element is suitably adapted to be in connection with a second end of the first right connecting member, the first end of the first left angle element is suitably adapted to be in connection with a first end of an elongate first left base member, and the first end of the first right angle element is suitably adapted to be in connection with a first end of an elongate first right base member;

a front angle element and a rear angle element, with each angle element being substantially elongate and having a first end and a second end, with the first end of the angle element being substantially cylindrical and having a hollow interior, a substantially uniform inside diameter, and an opening allowing access into the interior, and the second end of the angle element being substantially cylindrical and having a hollow interior, a substantially uniform inside diameter, and an opening allowing access into the interior, with the first end of the angle element being oriented at an angle of between twenty and seventy degrees in respect to the second end of the angle element, whereby the second end of the front angle element is suitably adapted to be in connection with a second end of the front connecting member, the second end of the rear angle element is suitably adapted to be in connection with a second end of the rear connecting member, the first end of the front angle element is suitably adapted to be in connection with a first end of an elongate front base member, and the first end of the rear angle element is suitably adapted to be in connection with a first end of an elongate rear base member; and a front end cap and a rear end cap, with the front end cap suitably adapted to be in connection with a second end of the front base member, and the rear end cap suitably adapted to be in connection with a second end of the rear base member, wherein each end cap comprises a bottom side located opposite the corresponding base member and having attached to said bottom side one of the following group: a cushioned circumferential ring, one or more cushioned pads, and a crutch tip.

9. The frame system of claim 8 wherein the outer end of the left connection element of the first five-arm coupler is suitably adapted to receive through its opening the first end of the first left connecting member such that the first end of the first left connecting member is capable of being located within the interior of the left connection element of the first five-arm coupler, the outer end of the right connection element of the first five-arm coupler is suitably adapted to receive through its opening the first end of the first right connecting member such that the first end of the first right connecting member is capable of being located within the interior of the right connection element of the first five-arm coupler, the outer end of the front connection element of the first five-arm coupler is suitably adapted to receive through its opening the first end of the front connecting member such that the first end of the front connecting member is capable of being located within the interior of the front connection element of the first five-arm coupler, the outer end of the rear connection element of the first five-arm coupler is suitably adapted to receive through its opening the first end of the rear connecting member such that the first end of the rear connecting member is capable of being located within the interior of the rear connection element of the first five-arm coupler, the outer end of the vertical connection element of the first five-arm coupler is suitably adapted to receive through its opening the first end of the first vertical connecting member such that the first end of the first vertical connecting member is capable of being located within the interior of the vertical connection element of the first five-arm coupler, the second end of the first left angle element is suitably adapted to receive through its opening the second end of the first left connecting member such that the second end of the first left connecting member is capable of being located within the interior of the second end of the first left angle element, the second end of the first right angle element is suitably adapted to receive through its opening the second end of the first right connecting member such that the second end of the first right connecting member is capable of being located within the interior of the second end of the first right angle element, the first end of the first left angle element is suitably adapted to receive through its opening the first end of the first left base member such that the first end of the first left base member is capable of being located within the interior of the first end of the first left angle element, the first end of the first right angle element is suitably adapted to receive through its opening the first end of the first right base member such that the first end of the first right base member is capable of being located within the interior of the first end of the first right angle element, the second end of the front angle element is suitably adapted to receive through its opening the second end of the front connecting member such that the second end of the front connecting member is capable of being located within the interior of the second end of the front angle element, the second end of the rear angle element is suitably adapted to receive through its opening the second end of the rear connecting member such that the second end of the rear connecting member is capable of being located within the interior of the second end of the rear angle element, the first end of the front angle element is suitably adapted to receive through its opening the first end of the front base member such that the first end of the front base member is capable of being located within the interior of the first end of the front angle element, and the first end of the rear angle element is suitably adapted to receive through its opening the first end of the rear base member such that the first end of the rear base member is capable of being located within the interior of the first end of the rear angle element.

10. The frame system of claim 8 wherein the front end cap is suitably adapted to being placed onto the second end of the front base member, and the rear end cap is suitably adapted to being placed onto the second end of the rear base member.

11. The frame system of claim 8 wherein the left connection element of the first five-arm coupler is suitably adapted to receive over its outer end the first end of the first left connecting member, said first end of the first left connecting member having an end aperture with an inside diameter substantially the same as the outside diameter of the outer end of the left connection element of the first five-arm coupler, such that the first end of the first left connecting member is capable of being located over the outer end of the left connection element of the first five-arm coupler, the right connection element of the first five-arm coupler is suitably adapted to receive over its outer end the first end of the first right connecting member, said first end of the first right connecting member having an end aperture with an inside diameter substantially the same as the outside diameter of the outer end of the right connection element of the first five-arm coupler, such that the first end of the first right connecting member is capable of being located over the outer end of the right connection element of the first five-arm coupler, the front connection element of the first five-arm coupler is suitably adapted to receive over its outer end the first end of the front connecting member, said first end of the front connecting member having an end aperture with an inside diameter substantially the same as the outside diameter of the outer end of the front connection element of the first five-arm coupler, such that the first end of the front connecting member is capable of being located over the outer end of the front connection element of the first five-arm coupler, the rear connection element of the first five-arm coupler is suitably adapted to receive over its outer end the first end of the rear connecting member, said first end of the rear connecting member having an end aperture with an inside diameter substantially the same as the outside diameter of the outer end of the rear connection element of the first five-arm coupler, such that the first end of the rear connecting member is capable of being located over the outer end of the rear connection element of the first five-arm coupler, the vertical connection element of the first five-arm coupler is suitably adapted to receive over its outer end the first end of the first vertical connecting member, said first end of the first vertical connecting member having an end aperture with an inside diameter substantially the same as the outside diameter of the outer end of the vertical connection element of the first five-arm coupler, such that the first end of the first vertical connecting member is capable of being located over the outer end of the vertical connection element of the first five-arm coupler, the first left angle element is suitably adapted to receive over its second end the second end of the first left connecting member, said second end of the first left connecting member having an end aperture with an inside diameter substantially the same as the outside diameter of the second end of the first left angle element, such that the second end of the first left connecting member is capable of being located over the second end of the first left angle element, the first right angle element is suitably adapted to receive over its second end the second end of the first right connecting member, said second end of the first right connecting member having an end aperture with an inside diameter substantially the same as the outside diameter of the second end of the first right angle element, such that the second end of the first right connecting member is capable of being located over the second end of the first right angle element, the first left angle element is suitably adapted to receive over its first end the first end of the first left base member, said first end of the first left base member having an end aperture with an inside diameter substantially the same as the outside diameter of the first end of the first left angle element, such that the first end of the first left base member is capable of being located over the first end of the first left angle element, the first right angle element is suitably adapted to receive over its first end the first end of the first right base member, said first end of the first right base member having an end aperture with an inside diameter substantially the same as the outside diameter of the first end of the first right angle element, such that the first end of the first right base member is capable of being located over the first end of the first right angle element, the front angle element is suitably adapted to receive over its second end the second end of the front connecting member, said second end of the front connecting member having an end aperture with an inside diameter substantially the same as the outside diameter of the second end of the front angle element, such that the second end of the front connecting member is capable of being located over the second end of the front angle element, the rear angle element is suitably adapted to receive over its second end the second end of the rear connecting member, said second end of the rear connecting member having an end aperture with an inside diameter substantially the same as the outside diameter of the second end of the rear angle element, such that the second end of the rear connecting member is capable of being located over the second end of the rear angle element, the front angle element is suitably adapted to receive over its first end the first end of the front base member, said first end of the front base member having an end aperture with an inside diameter substantially the same as the outside diameter of the first end of the front angle element, such that the first end of the front base member is capable of being located over the first end of the front angle element, and the rear angle element is suitably adapted to receive over its first end the first end of the rear base member, said first end of the rear base member having an end aperture with an inside diameter substantially the same as the outside diameter of the first end of the rear angle element, such that the first end of the rear base member is capable of being located over the first end of the rear angle element.

12. The frame system of claim 8 wherein the front end cap is suitably adapted to being placed into an end aperture of the second end of the front base member, and the rear end cap is suitably adapted to being placed into an end aperture of the second end of the rear base member.

13. The frame system of claim 8 further comprising a second five-arm coupler, the second five-arm coupler having a left connection element, a right connection element, a front connection element, a rear connection element, and a vertical connection element, with each of the connection elements being substantially elongate and substantially cylindrical and having an outer end and a hollow interior, an opening through the outer end allowing access into the interior, and a substantially uniform inside diameter, whereby the front connection element of the second five-arm coupler is fixedly attached to and oriented substantially collinear with the rear connection element of the second five-arm coupler, forming a substantially cylindrical cross member having openings at opposite ends, the left connection element of the second five-arm coupler is fixedly attached to a midsection of the cross member of the second five-arm coupler and oriented substantially perpendicular to the cross member of the second five-arm coupler and further oriented at an angle of between twenty and seventy degrees to a plane of the cross member of the second five-arm coupler, the right connection element of the second five-arm coupler is fixedly attached to the midsection of the cross member of the second five-arm coupler opposite the left connection element of the second five-arm coupler and oriented substantially perpendicular to the cross member of the second five-arm coupler and further oriented at an angle to the plane of the cross member of the second five-arm coupler of substantially the same angle as that of the left connection element of the second five-arm coupler on the same side of the plane of the cross member of the second five-arm coupler as the left connection element of the second five-arm coupler, the vertical connection element of the second five-arm coupler is fixedly attached to the midsection of the cross member of the second five-arm coupler between the left connection element of the second five-arm coupler and the right connection element of the second five-arm coupler and oriented substantially perpendicular to the plane of the cross member of the second five-arm coupler on the same side of the plane of the cross member of the second five-arm coupler as the left connection element of the second five-arm coupler, the outer end of the left connection element of the second five-arm coupler is suitably adapted to be in connection with a first end of an elongate second left connecting member, the outer end of the right connection element of the second five-arm coupler is suitably adapted to be in connection with a first end of an elongate second right connecting member, the outer end of the front connection element of the second five-arm coupler is suitably adapted to be in connection with a second end of an elongate intermediate connecting member, the outer end of the rear connection element of the second five-arm coupler is suitably adapted to be in connection with the first end of the rear connecting member, the outer end of the vertical connection element of the second five-arm coupler is suitably adapted to be in connection with a first end of an elongate second vertical connecting member; and a second left angle element and a second right angle element, with each angle element being substantially elongate and having a first end and a second end, with the first end of the angle element being substantially cylindrical and having a hollow interior, a substantially uniform inside diameter, and an opening allowing access into the interior, and the second end of the angle element being substantially cylindrical and having a hollow interior, a substantially uniform inside diameter, and an opening allowing access into the interior, with the first end of the angle element being oriented at an angle of delta degrees in respect to the second end of the angle element, whereby delta is the difference between ninety degrees and the degree of the angle between the outer end of the left connection element of the second five-arm coupler and the plane of the cross member of the second five-arm coupler, whereby the second end of the second left angle element is suitably adapted to be in connection with a second end of the second left connecting member, the second end of the second right angle element is suitably adapted to be in connection with a second end of the second right connecting member, the first end of the second left angle element is suitably adapted to be in connection with a first end of an elongate second left base member, and the first end of the second right angle element is suitably adapted to be in connection with a first end of an elongate second right base member;

whereby the outer end of the rear connection element of the first five-arm coupler is suitably adapted to be in connection with a first end of the intermediate connecting member.

14. The frame system of claim 13 wherein the outer end of the left connection element of the first five-arm coupler is suitably adapted to receive through its opening the first end of the first left connecting member such that the first end of the first left connecting member is capable of being located within the interior of the left connection element of the first five-arm coupler, the outer end of the right connection element of the first five-arm coupler is suitably adapted to receive through its opening the first end of the first right connecting member such that the first end of the first right connecting member is capable of being located within the interior of the right connection element of the first five-arm coupler, the outer end of the front connection element of the first five-arm coupler is suitably adapted to receive through its opening the first end of the front connecting member such that the first end of the front connecting member is capable of being located within the interior of the front connection element of the first five-arm coupler, the outer end of the rear connection element of the first five-arm coupler is suitably adapted to receive through its opening the first end of the intermediate connecting member such that the first end of the intermediate connecting member is capable of being located within the interior of the rear connection element of the first five-arm coupler, the outer end of the vertical connection element of the first five-arm coupler is suitably adapted to receive through its opening the first end of the first vertical connecting member such that the first end of the first vertical connecting member is capable of being located within the interior of the vertical connection element of the first five-arm coupler, the second end of the first left angle element is suitably adapted to receive through its opening the second end of the first left connecting member such that the second end of the first left connecting member is capable of being located within the interior of the second end of the first left angle element, the second end of the first right angle element is suitably adapted to receive through its opening the second end of the first right connecting member such that the second end of the first right connecting member is capable of being located within the interior of the second end of the first right angle element, the first end of the first left angle element is suitably adapted to receive through its opening the first end of the first left base member such that the first end of the first left base member is capable of being located within the interior of the first end of the first left angle element, the first end of the first right angle element is suitably adapted to receive through its opening the first end of the first right base member such that the first end of the first right base member is capable of being located within the interior of the first end of the first right angle element, the second end of the front angle element is suitably adapted to receive through its opening the second end of the front connecting member such that the second end of the front connecting member is capable of being located within the interior of the second end of the front angle element, the second end of the rear angle element is suitably adapted to receive through its opening the second end of the rear connecting member such that the second end of the rear connecting member is capable of being located within the interior of the second end of the rear angle element, the first end of the front angle element is suitably adapted to receive through its opening the first end of the front base member such that the first end of the front base member is capable of being located within the interior of the first end of the front angle element, and the first end of the rear angle element is suitably adapted to receive through its opening the first end of the rear base member such that the first end of the rear base member is capable of being located within the interior of the first end of the rear angle element, the outer end of the left connection element of the second five-arm coupler is suitably adapted to receive through its opening the first end of the second left connecting member such that the first end of the second left connecting member is capable of being located within the interior of the left connection element of the second five-arm coupler, the outer end of the right connection element of the second five-arm coupler is suitably adapted to receive through its opening the first end of the second right connecting member such that the first end of the second right connecting member is capable of being located within the interior of the right connection element of the second five-arm coupler, the outer end of the front connection element of the second five-arm coupler is suitably adapted to receive through its opening the second end of the intermediate connecting member such that the second end of the intermediate connecting member is capable of being located within the interior of the front connection element of the second five-arm coupler, the outer end of the rear connection element of the second five-arm coupler is suitably adapted to receive through its opening the first end of the rear connecting member such that the first end of the rear connecting member is capable of being located within the interior of the rear connection element of the second five-arm coupler, the outer end of the vertical connection element of the second five-arm coupler is suitably adapted to receive through its opening the first end of the second vertical connecting member such that the first end of the second vertical connecting member is capable of being located within the interior of the vertical connection element of the second five-arm coupler, the second end of the second left angle element is suitably adapted to receive through its opening the second end of the second left connecting member such that the second end of the second left connecting member is capable of being located within the interior of the second end of the second left angle element, the second end of the second right angle element is suitably adapted to receive through its opening the second end of the second right connecting member such that the second end of the second right connecting member is capable of being located within the interior of the second end of the second right angle element, the first end of the second left angle element is suitably adapted to receive through its opening the first end of the second left base member such that the first end of the second left base member is capable of being located within the interior of the first end of the second left angle element, and the first end of the second right angle element is suitably adapted to receive through its opening the first end of the second right base member such that the first end of the second right base member is capable of being located within the interior of the first end of the second right angle element.

15. The frame system of claim 13 wherein the front end cap is suitably adapted to being placed onto the second end of the front base member, and the rear end cap is suitably adapted to being placed onto the second end of the rear base member.

16. The frame system of claim 13 wherein the left connection element of the first five-arm coupler is suitably adapted to receive over its outer end the first end of the first left connecting member, said first end of the first left connecting member having an end aperture with an inside diameter substantially the same as the outside diameter of the outer end of the left connection element of the first five-arm coupler, such that the first end of the first left connecting member is capable of being located over the outer end of the left connection element of the first five-arm coupler, the right connection element of the first five-arm coupler is suitably adapted to receive over its outer end the first end of the first right connecting member, said first end of the first right connecting member having an end aperture with an inside diameter substantially the same as the outside diameter of the outer end of the right connection element of the first five-arm coupler, such that the first end of the first right connecting member is capable of being located over the outer end of the right connection element of the first five-arm coupler, the front connection element of the first five-arm coupler is suitably adapted to receive over its outer end the first end of the front connecting member, said first end of the front connecting member having an end aperture with an inside diameter substantially the same as the outside diameter of the outer end of the front connection element of the first five-arm coupler, such that the first end of the front connecting member is capable of being located over the outer end of the front connection element of the first five-arm coupler, the rear connection element of the first five-arm coupler is suitably adapted to receive over its outer end the first end of the intermediate connecting member, said first end of the intermediate connecting member having an end aperture with an inside diameter substantially the same as the outside diameter of the outer end of the rear connection element of the first five-arm coupler, such that the first end of the intermediate connecting member is capable of being located over the outer end of the rear connection element of the first five-arm coupler, the vertical connection element of the first five-arm coupler is suitably adapted to receive over its outer end the first end of the first vertical connecting member, said first end of the first vertical connecting member having an end aperture with an inside diameter substantially the same as the outside diameter of the outer end of the vertical connection element of the first five-arm coupler, such that the first end of the first vertical connecting member is capable of being located over the outer end of the vertical connection element of the first five-arm coupler, the first left angle element is suitably adapted to receive over its second end the second end of the first left connecting member, said second end of the first left connecting member having an end aperture with an inside diameter substantially the same as the outside diameter of the second end of the first left angle element, such that the second end of the first left connecting member is capable of being located over the second end of the first left angle element, the first right angle element is suitably adapted to receive over its second end the second end of the first right connecting member, said second end of the first right connecting member having an end aperture with an inside diameter substantially the same as the outside diameter of the second end of the first right angle element, such that the second end of the first right connecting member is capable of being located over the second end of the first right angle element, the first left angle element is suitably adapted to receive over its first end the first end of the first left base member, said first end of the first left base member having an end aperture with an inside diameter substantially the same as the outside diameter of the first end of the first left angle element, such that the first end of the first left base member is capable of being located over the first end of the first left angle element, the first right angle element is suitably adapted to receive over its first end the first end of the first right base member, said first end of the first right base member having an end aperture with an inside diameter substantially the same as the outside diameter of the first end of the first right angle element, such that the first end of the first right base member is capable of being located over the first end of the first right angle element, the left connection element of the second five-arm coupler is suitably adapted to receive over its outer end the first end of the second left connecting member, said first end of the second left connecting member having an end aperture with an inside diameter substantially the same as the outside diameter of the outer end of the left connection element of the second five-arm coupler, such that the first end of the second left connecting member is capable of being located over the outer end of the left connection element of the second five-arm coupler, the right connection element of the second five-arm coupler is suitably adapted to receive over its outer end the first end of the second right connecting member, said first end of the second right connecting member having an end aperture with an inside diameter substantially the same as the outside diameter of the outer end of the right connection element of the second five-arm coupler, such that the first end of the second right connecting member is capable of being located over the outer end of the right connection element of the second five-arm coupler, the front connection element of the second five-arm coupler is suitably adapted to receive over its outer end the second end of the intermediate connecting member, said second end of the intermediate connecting member having an end aperture with an inside diameter substantially the same as the outside diameter of the outer end of the front connection element of the second five-arm coupler, such that the second end of the intermediate connecting member is capable of being located over the outer end of the front connection element of the second five-arm coupler, the rear connection element of the second five-arm coupler is suitably adapted to receive over its outer end the first end of the rear connecting member, said first end of the rear connecting member having an end aperture with an inside diameter substantially the same as the outside diameter of the outer end of the rear connection element of the second five-arm coupler, such that the first end of the rear connecting member is capable of being located over the outer end of the rear connection element of the second five-arm coupler, the vertical connection element of the second five-arm coupler is suitably adapted to receive over its outer end the first end of the second vertical connecting member, said first end of the second vertical connecting member having an end aperture with an inside diameter substantially the same as the outside diameter of the outer end of the vertical connection element of the second five-arm coupler, such that the first end of the second vertical connecting member is capable of being located over the outer end of the vertical connection element of the second five-arm coupler, the second left angle element is suitably adapted to receive over its second end the second end of the second left connecting member, said second end of the second left connecting member having an end aperture with an inside diameter substantially the same as the outside diameter of the second end of the second left angle element, such that the second end of the second left connecting member is capable of being located over the second end of the second left angle element, the second right angle element is suitably adapted to receive over its second end the second end of the second right connecting member, said second end of the second right connecting member having an end aperture with an inside diameter substantially the same as the outside diameter of the second end of the second right angle element, such that the second end of the second right connecting member is capable of being located over the second end of the second right angle element, the second left angle element is suitably adapted to receive over its first end the first end of the second left base member, said first end of the second left base member having an end aperture with an inside diameter substantially the same as the outside diameter of the first end of the second left angle element, such that the first end of the second left base member is capable of being located over the first end of the second left angle element, the second right angle element is suitably adapted to receive over its first end the first end of the second right base member, said first end of the second right base member having an end aperture with an inside diameter substantially the same as the outside diameter of the first end of the second right angle element, such that the first end of the second right base member is capable of being located over the first end of the second right angle element, the front angle element is suitably adapted to receive over its second end the second end of the front connecting member, said second end of the front connecting member having an end aperture with an inside diameter substantially the same as the outside diameter of the second end of the front angle element, such that the second end of the front connecting member is capable of being located over the second end of the front angle element, the rear angle element is suitably adapted to receive over its second end the second end of the rear connecting member, said second end of the rear connecting member having an end aperture with an inside diameter substantially the same as the outside diameter of the second end of the rear angle element, such that the second end of the rear connecting member is capable of being located over the second end of the rear angle element, the front angle element is suitably adapted to receive over its first end the first end of the front base member, said first end of the front base member having an end aperture with an inside diameter substantially the same as the outside diameter of the first end of the front angle element, such that the first end of the front base member is capable of being located over the first end of the front angle element, and the rear angle element is suitably adapted to receive over its first end the first end of the rear base member, said first end of the rear base member having an end aperture with an inside diameter substantially the same as the outside diameter of the first end of the rear angle element, such that the first end of the rear base member is capable of being located over the first end of the rear angle element.

17. The frame system of claim 13 wherein the front end cap is suitably adapted to being placed into an end aperture of the second end of the front base member, and the rear end cap is suitably adapted to being placed into an end aperture of the second end of the rear base member.

18. A frame system comprising a first five-arm coupler, the first five-arm coupler having a left connection element, a right connection element, a front connection element, a rear connection element, and a vertical connection element, with each of the connection elements being substantially elongate and substantially cylindrical and having an outer end and a hollow interior, an opening through the outer end allowing access into the interior, and a substantially uniform inside diameter, whereby the front connection element of the first five-arm coupler is fixedly attached to and oriented substantially collinear with the rear connection element of the first five-arm coupler, forming a substantially cylindrical cross member of the first five-arm coupler having openings at opposite ends, the left connection element of the first five-arm coupler is fixedly attached to a midsection of the cross member of the first five-arm coupler and oriented substantially perpendicular to the cross member of the first five-arm coupler and further oriented at an angle of between twenty and seventy degrees to a plane of the cross member of the first five-arm coupler, the right connection element of the first five-arm coupler is fixedly attached to the midsection of the cross member of the first five-arm coupler opposite the left connection element of the first five-arm coupler and oriented substantially perpendicular to the cross member of the first five-arm coupler and further oriented at an angle to the plane of the cross member of the first five-arm coupler of substantially the same angle as that of the left connection element of the first five-arm coupler on the same side of the plane of the cross member of the first five-arm coupler as the left connection element of the first five-arm coupler, the vertical connection element of the first five-arm coupler is fixedly attached to the midsection of the cross member of the first five-arm coupler between the left connection element of the first five-arm coupler and the right connection element of the first five-arm coupler and oriented substantially perpendicular to the plane of the cross member of the first five-arm coupler on the same side of the plane of the cross member of the first five-arm coupler as the left connection element of the first five-arm coupler, the outer end of the left connection element of the first five-arm coupler is suitably adapted to be in connection with a first end of an elongate first left connecting member such that the first left connecting member is capable of being attached to the left connection element of the first five-arm coupler, the outer end of the right connection element of the first five-arm coupler is suitably adapted to be in connection with a first end of an elongate first right connecting member such that the first right connecting member is capable of being attached to the right connection element of the first five-arm coupler, the outer end of the front connection element of the first five-arm coupler is suitably adapted to be in connection with a first end of an elongate front connecting member such that the front connecting member is capable of being attached to the front connection element of the first five-arm coupler, the outer end of the rear connection element of the first five-arm coupler is suitably adapted to be in connection with a first end of an elongate first intermediate connecting member such that the first intermediate connecting member is capable of being attached to the rear connection element of the first five-arm coupler, the outer end of the vertical connection element of the first five-arm coupler is suitably adapted to be in connection with a first end of an elongate first vertical connecting member such that the first vertical connecting member is capable of being attached to the vertical connection element of the first five-arm coupler;

a second five-arm coupler, the second five-arm coupler having a left connection element, a right connection element, a front connection element, a rear connection element, and a vertical connection element, with each of the connection elements being substantially elongate and substantially cylindrical and having an outer end and a hollow interior, an opening through the outer end allowing access into the interior, and a substantially uniform inside diameter, whereby the front connection element of the second five-arm coupler is fixedly attached to and oriented substantially collinear with the rear connection element of the second five-arm coupler, forming a substantially cylindrical cross member having openings at opposite ends, the left connection element of the second five-arm coupler is fixedly attached to a midsection of the cross member of the second five-arm coupler and oriented substantially perpendicular to the cross member of the second five-arm coupler and further oriented at an angle of between twenty and seventy degrees to a plane of the cross member of the second five-arm coupler, the right connection element of the second five-arm coupler is fixedly attached to the midsection of the cross member of the second five-arm coupler opposite the left connection element of the second five-arm coupler and oriented substantially perpendicular to the cross member of the second five-arm coupler and further oriented at an angle to the plane of the cross member of the second five-arm coupler of substantially the same angle as that of the left connection element of the second five-arm coupler on the same side of the plane of the cross member of the second five-arm coupler as the left connection element of the second five-arm coupler, the vertical connection element of the second five-arm coupler is fixedly attached to the midsection of the cross member of the second five-arm coupler between the left connection element of the second five-arm coupler and the right connection element of the second five-arm coupler and oriented substantially perpendicular to the plane of the cross member of the second five-arm coupler on the same side of the plane of the cross member of the second five-arm coupler as the left connection element of the second five-arm coupler, whereby the outer end of the left connection element of the second five-arm coupler is suitably adapted to be in connection with a first end of an elongate second left connecting member such that the second left connecting member is capable of being attached to the left connection element of the second five-arm coupler, the outer end of the right connection element of the second five-arm coupler is suitably adapted to be in connection with a first end of an elongate second right connecting member such that the second right connecting member is capable of being attached to the right connection element of the second five-arm coupler, the outer end of the rear connection element of the second five-arm coupler is suitably adapted to be in connection with a first end of an elongate rear connecting member such that the rear connecting member is capable of being attached to the rear connection element of the second five-arm coupler, the outer end of the vertical connection element of the second five-arm coupler is suitably adapted to be in connection with a first end of an elongate second vertical connecting member such that the second vertical connecting member is capable of being attached to the vertical connection element of the second five-arm coupler;

a first left angle element and a first right angle element, with each angle element being substantially elongate and having a first end and a second end, with the first end of the angle element being substantially cylindrical and having a hollow interior, a substantially uniform inside diameter, and an opening allowing access into the interior, and the second end of the angle element being substantially cylindrical and having a hollow interior, a substantially uniform inside diameter, and an opening allowing access into the interior, with the first end of the angle element being oriented at an angle of delta degrees in respect to the second end of the angle element, whereby delta is the difference between ninety degrees and the degree of the angle between the outer end of the left connection element and the plane of the cross member, whereby the second end of the first left angle element is suitably adapted to be in connection with a second end of the first left connecting member such that the first left connecting member is capable of being attached to the first left angle element, the second end of the first right angle element is suitably adapted to be in connection with a second end of the first right connecting member such that the first right connecting member is capable of being attached to the first right angle element, the first end of the first left angle element is suitably adapted to be in connection with a first end of an elongate first left base member such that the first left base member is capable of being attached to the first left angle element, and the first end of the first right angle element is suitably adapted to be in connection with a first end of an elongate first right base member such that the first right base member is capable of being attached to the first right angle element;

a second left angle element and a second right angle element, with each second angle element being substantially elongate and having a first end and a second end, with the first end of the second angle element being substantially cylindrical and having a hollow interior, a substantially uniform inside diameter, and an opening allowing access into the interior, and the second end of the second angle element being substantially cylindrical and having a hollow interior, a substantially uniform inside diameter, and an opening allowing access into the interior, with the first end of the second angle element being oriented at an angle of delta degrees in respect to the second end of the second angle element, whereby delta is the difference between ninety degrees and the degree of the angle between the outer end of the left connection element of the second five-arm coupler and the plane of the cross member of the second five-arm coupler, whereby the second end of the second left angle element is suitably adapted to be in connection with a second end of the second left connecting member such that the second left connecting member is capable of being attached to the second left angle element, the second end of the second right angle element is suitably adapted to be in connection with a second end of the second right connecting member such that the second right connecting member is capable of being attached to the second right angle element, the first end of the second left angle element is suitably adapted to be in connection with a first end of an elongate second left base member such that the second left base member is capable of being attached to the second left angle element, and the first end of the second right angle element is suitably adapted to be in connection with a first end of an elongate second right base member such that the second right base member is capable of being attached to the second right angle element; and a front three-arm coupler, a rear three-arm coupler, and four ninety degree angle couplers, with each three-arm coupler having a left connection element, a right connection element, and a horizontal connection element, with each of the connection elements of each three-arm coupler being substantially elongate and substantially cylindrical and having an outer end and a hollow interior, an opening through the outer end allowing access into the interior, and a substantially uniform inside diameter, whereby for each three-arm coupler the left connection element is fixedly attached to and oriented substantially collinear with a right connection element, forming a substantially cylindrical cross member having openings at opposite ends, and the horizontal connection element is fixedly attached to a midsection of the cross member between the left connection element and the right connection element and oriented substantially perpendicular to the cross member, and with each ninety degree angle coupler being substantially elongate and having a first end and a second end, with the first end of each ninety degree angle coupler being substantially cylindrical and having a hollow interior, a substantially uniform inside diameter, and an opening allowing access into the interior, and the second end of each ninety degree angle coupler being substantially cylindrical and having a hollow interior, a substantially uniform inside diameter, and an opening allowing access into the interior, with the first end of each ninety degree angle coupler being oriented at an angle of ninety degrees in respect to the second end of said ninety degree angle coupler, whereby the left connection element of the front three-arm coupler is suitably adapted to be joined to one of the ninety degree couplers by a first horizontal connecting member, the right connection element of the front three-arm coupler is suitably adapted to be joined to a second of the ninety degree couplers by a second horizontal connecting member, the left connection element of the rear three-arm coupler is suitably adapted to be joined to a third of the ninety degree couplers by a third horizontal connecting member, the right connection element of the rear three-arm coupler is suitably adapted to be joined to a fourth of the ninety degree couplers by a fourth horizontal connecting member, the first ninety degree coupler is suitably adapted to be joined to the third ninety degree coupler by a fifth horizontal connecting member, the second ninety degree coupler is suitably adapted to be joined to the fourth ninety degree coupler by a sixth horizontal connecting member, the outer end of the horizontal connection element of the front three-arm coupler is suitably adapted to be in connection with a second end of the first intermediate connecting member such that the first intermediate connecting member is capable of being attached to the horizontal connection element of the front three-arm coupler, the outer end of the horizontal connection element of the rear three-arm coupler is suitably adapted to be in connection with a first end of an elongate second intermediate connecting member such that the second intermediate connecting member is capable of being attached to the horizontal connection element of the rear three-arm coupler, and the outer end of the front connection element of the second five-arm coupler is suitably adapted to be in connection with a second end of the second intermediate connecting member such that the second intermediate connecting member is capable of being attached to the front connection element of the second five-arm coupler.

19. The frame system of claim 18 wherein the outer end of the left connection element of the first five-arm coupler is suitably adapted to receive through its opening the first end of the first left connecting member such that the first end of the first left connecting member is capable of being located within the interior of the left connection element of the first five-arm coupler, the outer end of the right connection element of the first five-arm coupler is suitably adapted to receive through its opening the first end of the first right connecting member such that the first end of the first right connecting member is capable of being located within the interior of the right connection element of the first five-arm coupler, the outer end of the front connection element of the first five-arm coupler is suitably adapted to receive through its opening the first end of the front connecting member such that the first end of the front connecting member is capable of being located within the interior of the front connection element of the first five-arm coupler, the outer end of the rear connection element of the first five-arm coupler is suitably adapted to receive through its opening the first end of the first intermediate connecting member such that the first end of the first intermediate connecting member is capable of being located within the interior of the rear connection element of the first five-arm coupler, the outer end of the vertical connection element of the first five-arm coupler is suitably adapted to receive through its opening the first end of the first vertical connecting member such that the first end of the first vertical connecting member is capable of being located within the interior of the vertical connection element of the first five-arm coupler, the second end of the first left angle element is suitably adapted to receive through its opening the second end of the first left connecting member such that the second end of the first left connecting member is capable of being located within the interior of the second end of the first left angle element, the second end of the first right angle element is suitably adapted to receive through its opening the second end of the first right connecting member such that the second end of the first right connecting member is capable of being located within the interior of the second end of the first right angle element, the first end of the first left angle element is suitably adapted to receive through its opening the first end of the first left base member such that the first end of the first left base member is capable of being located within the interior of the first end of the first left angle element, the first end of the first right angle element is suitably adapted to receive through its opening the first end of the first right base member such that the first end of the first right base member is capable of being located within the interior of the first end of the first right angle element, the outer end of the left connection element of the second five-arm coupler is suitably adapted to receive through its opening the first end of the second left connecting member such that the first end of the second left connecting member is capable of being located within the interior of the left connection element of the second five-arm coupler, the outer end of the right connection element of the second five-arm coupler is suitably adapted to receive through its opening the first end of the second right connecting member such that the first end of the second right connecting member is capable of being located within the interior of the right connection element of the second five-arm coupler, the outer end of the front connection element of the second five-arm coupler is suitably adapted to receive through its opening the second end of the second intermediate connecting member such that the second end of the second intermediate connecting member is capable of being located within the interior of the front connection element of the second five-arm coupler, the outer end of the rear connection element of the second five-arm coupler is suitably adapted to receive through its opening the first end of the rear connecting member such that the first end of the rear connecting member is capable of being located within the interior of the rear connection element of the second five-arm coupler, the outer end of the vertical connection element of the second five-arm coupler is suitably adapted to receive through its opening the first end of the second vertical connecting member such that the first end of the second vertical connecting member is capable of being located within the interior of the vertical connection element of the second five-arm coupler, the second end of the second left angle element is suitably adapted to receive through its opening the second end of the second left connecting member such that the second end of the second left connecting member is capable of being located within the interior of the second end of the second left angle element, the second end of the second right angle element is suitably adapted to receive through its opening the second end of the second right connecting member such that the second end of the second right connecting member is capable of being located within the interior of the second end of the second right angle element, the first end of the second left angle element is suitably adapted to receive through its opening the first end of the second left base member such that the first end of the second left base member is capable of being located within the interior of the first end of the second left angle element, the first end of the second right angle element is suitably adapted to receive through its opening the first end of the second right base member such that the first end of the second right base member is capable of being located within the interior of the first end of the second right angle element, the outer end of the horizontal connection element of the front three-arm coupler is suitably adapted to receive through its opening the second end of the first intermediate connecting member such that the second end of the first intermediate connecting member is capable of being located within the interior of the horizontal connection element of the front three-arm coupler and the first intermediate connecting member is capable of being attached to the horizontal connection element of the front three-arm coupler, and the outer end of the horizontal connection element of the rear three-arm coupler is suitably adapted to receive through its opening the first end of the second intermediate connecting member such that the first end of the second intermediate connecting member is capable of being located within the interior of the horizontal connection element of the rear three-arm coupler and the second intermediate connecting member is capable of being attached to the horizontal connection element of the rear three-arm coupler.

20. The frame system of claim 18 wherein the left connection element of the first five-arm coupler is suitably adapted to receive over its outer end the first end of the first left connecting member, said first end of the first left connecting member having an end aperture with an inside diameter substantially the same as the outside diameter of the outer end of the left connection element of the first five-arm coupler, such that the first end of the first left connecting member is capable of being located over the outer end of the left connection element of the first five-arm coupler, the right connection element of the first five-arm coupler is suitably adapted to receive over its outer end the first end of the first right connecting member, said first end of the first right connecting member having an end aperture with an inside diameter substantially the same as the outside diameter of the outer end of the right connection element of the first five-arm coupler, such that the first end of the first right connecting member is capable of being located over the outer end of the right connection element of the first five-arm coupler, the front connection element of the first five-arm coupler is suitably adapted to receive over its outer end the first end of the front connecting member, said first end of the front connecting member having an end aperture with an inside diameter substantially the same as the outside diameter of the outer end of the front connection element of the first five-arm coupler, such that the first end of the front connecting member is capable of being located over the outer end of the front connection element of the first five-arm coupler, the rear connection element of the first five-arm coupler is suitably adapted to receive over its outer end the first end of the first intermediate connecting member, said first end of the first intermediate connecting member having an end aperture with an inside diameter substantially the same as the outside diameter of the outer end of the rear connection element of the first five-arm coupler, such that the first end of the first intermediate connecting member is capable of being located over the outer end of the rear connection element of the first five-arm coupler, the vertical connection element of the first five-arm coupler is suitably adapted to receive over its outer end the first end of the first vertical connecting member, said first end of the first vertical connecting member having an end aperture with an inside diameter substantially the same as the outside diameter of the outer end of the vertical connection element of the first five-arm coupler, such that the first end of the first vertical connecting member is capable of being located over the outer end of the vertical connection element of the first five-arm coupler, the first left angle element is suitably adapted to receive over its second end the second end of the first left connecting member, said second end of the first left connecting member having an end aperture with an inside diameter substantially the same as the outside diameter of the second end of the first left angle element, such that the second end of the first left connecting member is capable of being located over the second end of the first left angle element, the first right angle element is suitably adapted to receive over its second end the second end of the first right connecting member, said second end of the first right connecting member having an end aperture with an inside diameter substantially the same as the outside diameter of the second end of the first right angle element, such that the second end of the first right connecting member is capable of being located over the second end of the first right angle element, the first left angle element is suitably adapted to receive over its first end the first end of the first left base member, said first end of the first left base member having an end aperture with an inside diameter substantially the same as the outside diameter of the first end of the first left angle element, such that the first end of the first left base member is capable of being located over the first end of the first left angle element, the first right angle element is suitably adapted to receive over its first end the first end of the first right base member, said first end of the first right base member having an end aperture with an inside diameter substantially the same as the outside diameter of the first end of the first right angle element, such that the first end of the first right base member is capable of being located over the first end of the first right angle element, the left connection element of the second five-arm coupler is suitably adapted to receive over its outer end the first end of the second left connecting member, said first end of the second left connecting member having an end aperture with an inside diameter substantially the same as the outside diameter of the outer end of the left connection element of the second five-arm coupler, such that the first end of the second left connecting member is capable of being located over the outer end of the left connection element of the second five-arm coupler, the right connection element of the second five-arm coupler is suitably adapted to receive over its outer end the first end of the second right connecting member, said first end of the second right connecting member having an end aperture with an inside diameter substantially the same as the outside diameter of the outer end of the right connection element of the second five-arm coupler, such that the first end of the second right connecting member is capable of being located over the outer end of the right connection element of the second five-arm coupler, the front connection element of the second five-arm coupler is suitably adapted to receive over its outer end the second end of the second intermediate connecting member, said second end of the second intermediate connecting member having an end aperture with an inside diameter substantially the same as the outside diameter of the outer end of the front connection element of the second five-arm coupler, such that the second end of the second intermediate connecting member is capable of being located over the outer end of the front connection element of the second five-arm coupler, the rear connection element of the second five-arm coupler is suitably adapted to receive over its outer end the first end of the rear connecting member, said first end of the rear connecting member having an end aperture with an inside diameter substantially the same as the outside diameter of the outer end of the rear connection element of the second five-arm coupler, such that the first end of the rear connecting member is capable of being located over the outer end of the rear connection element of the second five-arm coupler, the vertical connection element of the second five-arm coupler is suitably adapted to receive over its outer end the first end of the second vertical connecting member, said first end of the second vertical connecting member having an end aperture with an inside diameter substantially the same as the outside diameter of the outer end of the vertical connection element of the second five-arm coupler, such that the first end of the second vertical connecting member is capable of being located over the outer end of the vertical connection element of the second five-arm coupler, the second left angle element is suitably adapted to receive over its second end the second end of the second left connecting member, said second end of the second left connecting member having an end aperture with an inside diameter substantially the same as the outside diameter of the second end of the second left angle element, such that the second end of the second left connecting member is capable of being located over the second end of the second left angle element, the second right angle element is suitably adapted to receive over its second end the second end of the second right connecting member, said second end of the second right connecting member having an end aperture with an inside diameter substantially the same as the outside diameter of the second end of the second right angle element, such that the second end of the second right connecting member is capable of being located over the second end of the second right angle element, the second left angle element is suitably adapted to receive over its first end the first end of the second left base member, said first end of the second left base member having an end aperture with an inside diameter substantially the same as the outside diameter of the first end of the second left angle element, such that the first end of the second left base member is capable of being located over the first end of the second left angle element, the second right angle element is suitably adapted to receive over its first end the first end of the second right base member, said first end of the second right base member having an end aperture with an inside diameter substantially the same as the outside diameter of the first end of the second right angle element, such that the first end of the second right base member is capable of being located over the first end of the second right angle element, the horizontal connection element of the front three-arm coupler is suitably adapted to receive over its outer end the second end of the first intermediate connecting member, said second end of the first intermediate connecting member having an end aperture with an inside diameter substantially the same as the outside diameter of the horizontal connection element of the front three-arm coupler, such that the second end of the first intermediate connecting member is capable of being located over the horizontal connection element of the front three-arm coupler, and the horizontal connection element of the rear three-arm coupler is suitably adapted to receive over its outer end the first end of the second intermediate connecting member, said first end of the second intermediate connecting member having an end aperture with an inside diameter substantially the same as the outside diameter of the horizontal connection element of the rear three-arm coupler, such that the first end of the second intermediate connecting member is capable of being located over the horizontal connection element of the rear three-arm coupler.

* * * * *